US008011937B2

(12) United States Patent
Oddsen et al.

(10) Patent No.: US 8,011,937 B2
(45) Date of Patent: Sep. 6, 2011

(54) UNITARY MEMBER WITH MULTIPLE OUTLETS HAVING SURGE PROTECTION CIRCUITRY

(75) Inventors: Dennis A. Oddsen, Eatons Neck, NY (US); Steve Zacharevitz, Northport, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 11/558,831

(22) Filed: Nov. 10, 2006

(65) Prior Publication Data

US 2007/0149061 A1 Jun. 28, 2007

Related U.S. Application Data

(60) Continuation-in-part of application No. 11/112,899, filed on Apr. 22, 2005, which is a division of application No. 10/245,159, filed on Sep. 17, 2002, now Pat. No. 6,923,663.

(51) Int. Cl.
*H01R 4/66* (2006.01)

(52) U.S. Cl. ..... 439/107

(58) Field of Classification Search ..... 439/107, 439/108, 76, 650–655, 142, 131; 361/142
See application file for complete search history.

(56) References Cited

U.S. PATENT DOCUMENTS

| | | | | |
|---|---|---|---|---|
| 3,327,277 | A | | 6/1967 | Ramsing |
| 3,358,261 | A | | 12/1967 | Gaines et al. |
| 3,441,896 | A | | 4/1969 | Hawkins |
| 3,443,162 | A | | 5/1969 | Nudelmont |
| 3,478,295 | A | | 11/1969 | Grieshaber |
| 3,909,912 | A | | 10/1975 | Kiesling |
| 4,079,344 | A | | 3/1978 | Lauben et al. |
| 4,240,686 | A | | 12/1980 | Kurbikoff |
| 4,583,799 | A | * | 4/1986 | Wiley ..... 439/106 |
| D284,758 | S | * | 7/1986 | Maloney ..... D13/30 |
| 4,705,342 | A | | 11/1987 | Schwartz |
| 4,793,069 | A | | 12/1988 | McDowell |
| 4,930,047 | A | | 5/1990 | Peterson |
| 4,978,318 | A | | 12/1990 | Wiley et al. |
| 4,993,970 | A | * | 2/1991 | Littrell ..... 439/535 |

(Continued)

FOREIGN PATENT DOCUMENTS

| | | |
|---|---|---|
| CA | 2239573 | 12/1998 |

(Continued)

OTHER PUBLICATIONS

Notice of Allowance for U.S. Appl. No. 29/280,953, filed on Jun. 11, 2007. Notice of Allowance was mailed on Dec. 15, 2009. 28 pages.

(Continued)

*Primary Examiner* — Jean F Duverne
(74) *Attorney, Agent, or Firm* — Collard & Roe, P.C.

(57) ABSTRACT

A unitary body has both a plurality of outlets and protection circuitry integrated therein. An indicator device in the body provides a visual signal to indicate normal operation of the outlets. The protection circuitry may be a transient voltage surge suppressor (TVSS), a ground-fault circuit interrupter (GFCI), and/or an integrated circuit breaker. Another indicator device provides an audible signal in accordance with failure of the protection circuit. In a particular embodiment, the body has six outlets and the protection circuitry is a transient voltage surge suppressor (TVSS). The visual signal is provided by an LED, and an alarm buzzer sounds when the TVSS is disabled.

35 Claims, 27 Drawing Sheets

U.S. PATENT DOCUMENTS

| | | | | | |
|---|---|---|---|---|---|
| 5,073,681 | A | * | 12/1991 | Hubben et al. | 174/66 |
| 5,102,355 | A | * | 4/1992 | Murphy et al. | 439/649 |
| 5,135,411 | A | * | 8/1992 | Wiley et al. | 439/535 |
| 5,269,695 | A | | 12/1993 | Opel | |
| 5,383,799 | A | * | 1/1995 | Fladung | 439/652 |
| 5,460,542 | A | | 10/1995 | Castellani et al. | |
| 5,516,298 | A | | 5/1996 | Smith | |
| 5,601,455 | A | | 2/1997 | Bagga | |
| D379,796 | S | | 6/1997 | Bagga | |
| D402,186 | S | | 12/1998 | Pearse | |
| 5,899,761 | A | | 5/1999 | Crane et al. | |
| 5,906,517 | A | | 5/1999 | Crane et al. | |
| 6,179,665 | B1 | * | 1/2001 | Rossman et al. | 439/654 |
| 6,200,159 | B1 | | 3/2001 | Chou | |
| 6,259,023 | B1 | | 7/2001 | Reiker | |
| D446,503 | S | * | 8/2001 | Lee | D13/139.8 |
| 6,296,522 | B1 | * | 10/2001 | Ho | 439/640 |
| 6,315,617 | B1 | * | 11/2001 | Al-Sabah | 439/652 |
| 6,362,516 | B1 | * | 3/2002 | Waters | 257/678 |
| 6,443,746 | B1 | | 9/2002 | Yu | |
| 6,514,093 | B1 | | 2/2003 | Yu | |
| 6,568,946 | B1 | * | 5/2003 | Chou | 439/131 |
| 6,811,444 | B2 | | 11/2004 | Geyer | |
| 6,923,663 | B2 | | 8/2005 | Oddsen et al. | |
| 2004/0211591 | A1 | * | 10/2004 | Kumakura et al. | 174/256 |

FOREIGN PATENT DOCUMENTS

| | | |
|---|---|---|
| WO | 2004027798 | 4/2004 |

OTHER PUBLICATIONS

Notice of Allowance for U.S. Appl. No. 29/332,377, filed on Feb. 13, 2009. 44 pages.

International Search Report, mailed on Jul. 6, 2004 for International Application Publication No. WO 2004/027798; which was filed on Sep. 16, 2003. 3 pages.

Fnial Office Action for U.S. Appl. No. 11/112,899 Oddsen—2 Dated Apr. 2, 2010.

Office Actions From Oddsen 2 U.S. Appl. No. 11/112,899 Dated Nov. 2, 2009; Jul. 17, 2009; Apr. 8, 2009; Sep. 19, 2008; Apr. 3, 2008; Aug. 15, 2007; Mar. 21, 2007; Jul. 6, 2006; Mar. 13, 2006; Sep. 8, 2005.

Notice of Allowance for U.S. Appl. No. 29/280,953, filed on Jun. 11, 2007. Notice of Allowance was mailed on Dec. 15, 2009. 28 pages.

Notice of Allowance for U.S. Appl. No. 29/332,377, filed on Feb. 13, 2009. 45 pages.

Office Actions from U.S. Appl. No. 11/558,831 (Our Reference: ODDSEN—4) dated Jan. 11, 2007; Dec. 28, 2007; Jul. 22, 2008; Jan. 7, 2009; Sep. 3, 2009; and Jan. 7, 2010 with responses. 146 pages.

International Search Report, mailed on Jul. 6, 2004 for International Application Publication No. WO 2004/027798; which was filed on Sep. 16, 2003. 3 pages.

* cited by examiner

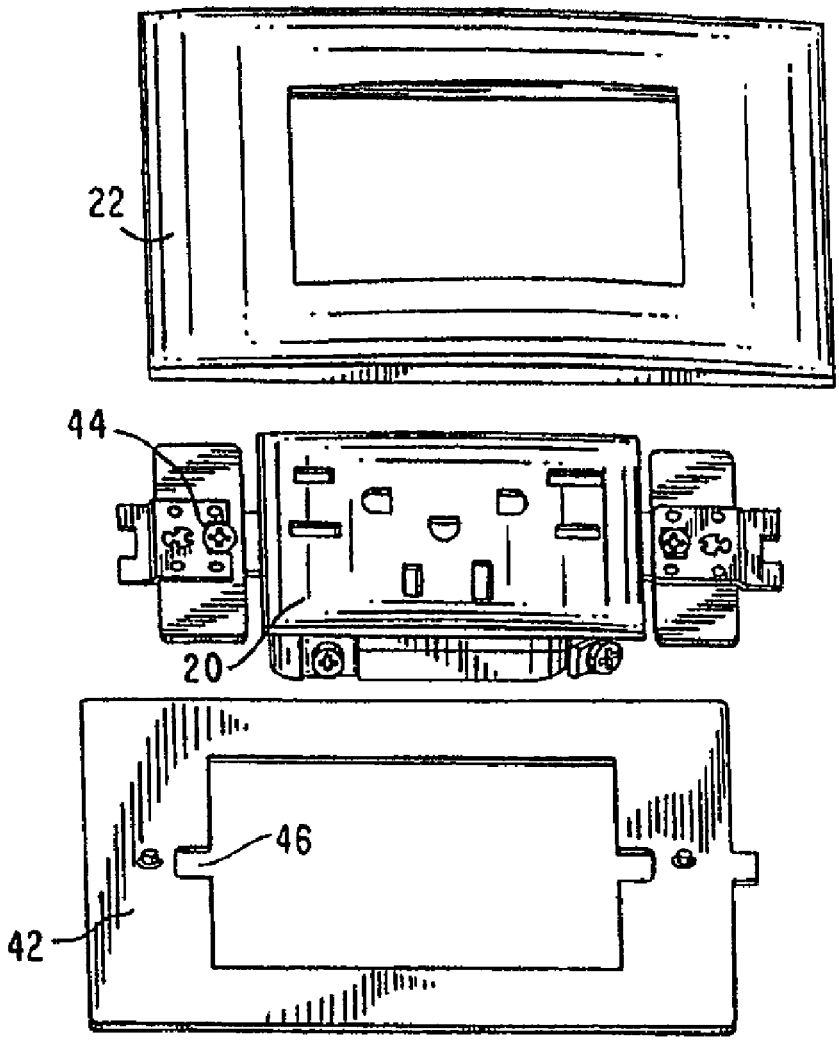
FIG.2
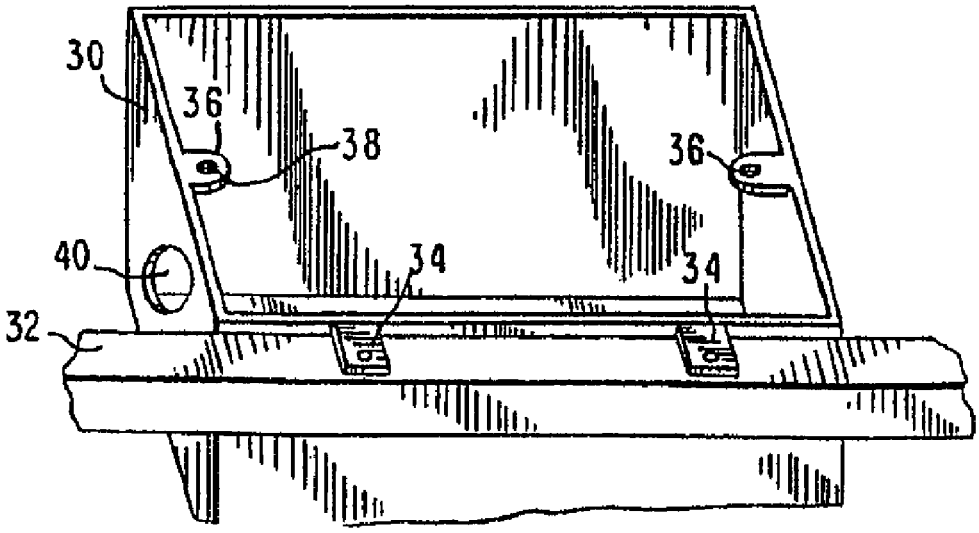

FIG. 10A
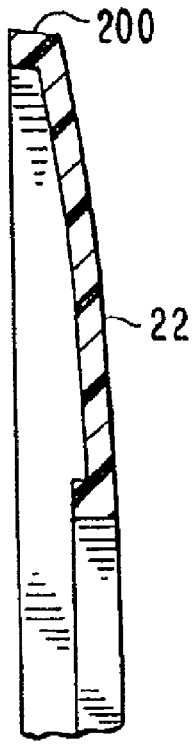
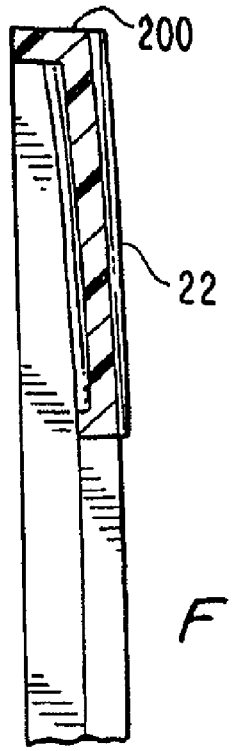
FIG. 10D
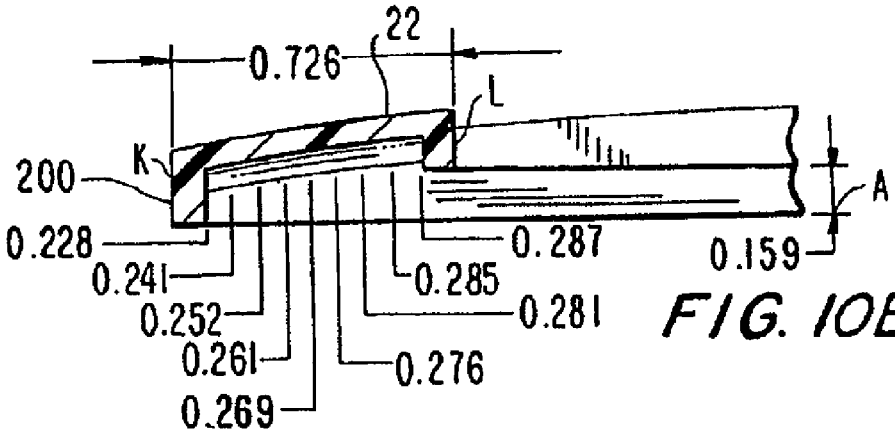
FIG. 10B
FIG. 10C
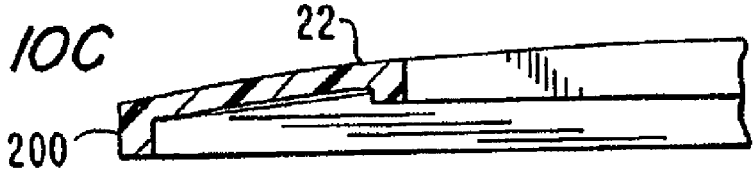

523

UNITARY MEMBER WITH MULTIPLE OUTLETS HAVING SURGE PROTECTION CIRCUITRY

CROSS-REFERENCE TO RELATED APPLICATIONS

This application is a continuation-in-part of U.S. application Ser. No. 11/112,899 filed Apr. 22, 2005, which is a division of U.S. application Ser. No. 10/245,159 filed Sep. 17, 2002, now U.S. Pat. No. 6,923,663.

FIELD OF THE INVENTION

This invention relates generally to wiring devices installed in boxes mounted in building walls, and more particularly to a device with a unitary body having multiple outlets which may be placed in two standard single boxes ganged together, and which has voltage surge protection circuitry.

BACKGROUND OF THE INVENTION

It is currently possible to mount a duplex receptacle in a single wiring box (called a gem box) installed in the wall of a building. It is also possible to mount two duplex receptacles side by side in two boxes joined together or in an enlarged box which can accept two duplex receptacles. In a conventional arrangement, two duplex receptacles are wired together to enable them to function as four receptacles.

A need exists for a single unit having more than two receptacles or sockets that can be mounted in a single box. A need also exists for a single unit having more than four receptacles or sockets that can be mounted in a double box and does not require separate interconnecting wiring.

Furthermore, it is highly desirable to provide protection in the receptacle against circuit faults (such as ground faults) and/or transient voltage surges. A wide variety of devices (e.g. personal computers, monitors, voice and data communication equipment) require such protection. Often a protective device, including one or more receptacles, is plugged into a conventional receptacle, and the sensitive equipment is then plugged into the receptacles of the protective device. The protective device could include a ground-fault circuit interrupter (GFCI) to detect a ground fault condition and interrupt power by breaking a connection between the line side and the load side; a transient voltage surge suppressor (TVSS) to interrupt power when a spike in voltage is detected; or any of similar components.

It is highly desirable to integrate protective devices, such as a GFCI or TVSS, into a receptacle installed in a wall. Furthermore, it is desirable to provide four or more outlets in such a receptacle mounted in a double box.

SUMMARY OF THE INVENTION

There is disclosed a single unit triplex receptacle having three sockets (outlets) that can be mounted in a single box, does not require separate interconnecting wiring and can be covered by a single wall plate. In addition, there is disclosed a single unit sixplex receptacle having six sockets that can be mounted in a double box, does not require separate interconnecting wiring and can be covered by a single wall plate. The single unit triplex receptacle and the single unit sixplex receptacle both have uninterrupted top members. The single unit triplex receptacle and the single unit sixplex receptacle optionally may have an isolated ground construction.

There is also disclosed a unitary body having both a plurality of outlets and protection circuitry integrated therein. In an embodiment, a visual signal indicates normal operation of the outlets. The protection circuitry may be a transient voltage surge suppressor (TVSS), a ground-fault circuit interrupter (GFCI), and/or an integrated circuit breaker. In another embodiment, a second indicator device provides an audible signal in accordance with failure of the protection circuit.

According to a particular embodiment of the invention, a unitary body (a sixplex receptacle) includes six outlets and the protection circuitry is a transient voltage surge suppressor (TVSS). The visual signal is provided by an LED, and an alarm buzzer sounds when the TVSS is disabled.

In other embodiments, three, four or five outlets are provided in a unitary body with one or more openings for making connection to a variety of low-voltage devices (voice, data, cable TV, etc.).

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals:

FIG. 2 is an exploded view of the single box, alignment plate, triplex receptacle and wall plate in accordance with the principles of the invention.

FIG. 10 is a view along the line B-B from edge L to edge K of FIG. 9.

DETAILED DESCRIPTION OF PREFERRED EMBODIMENTS

Figure 1:
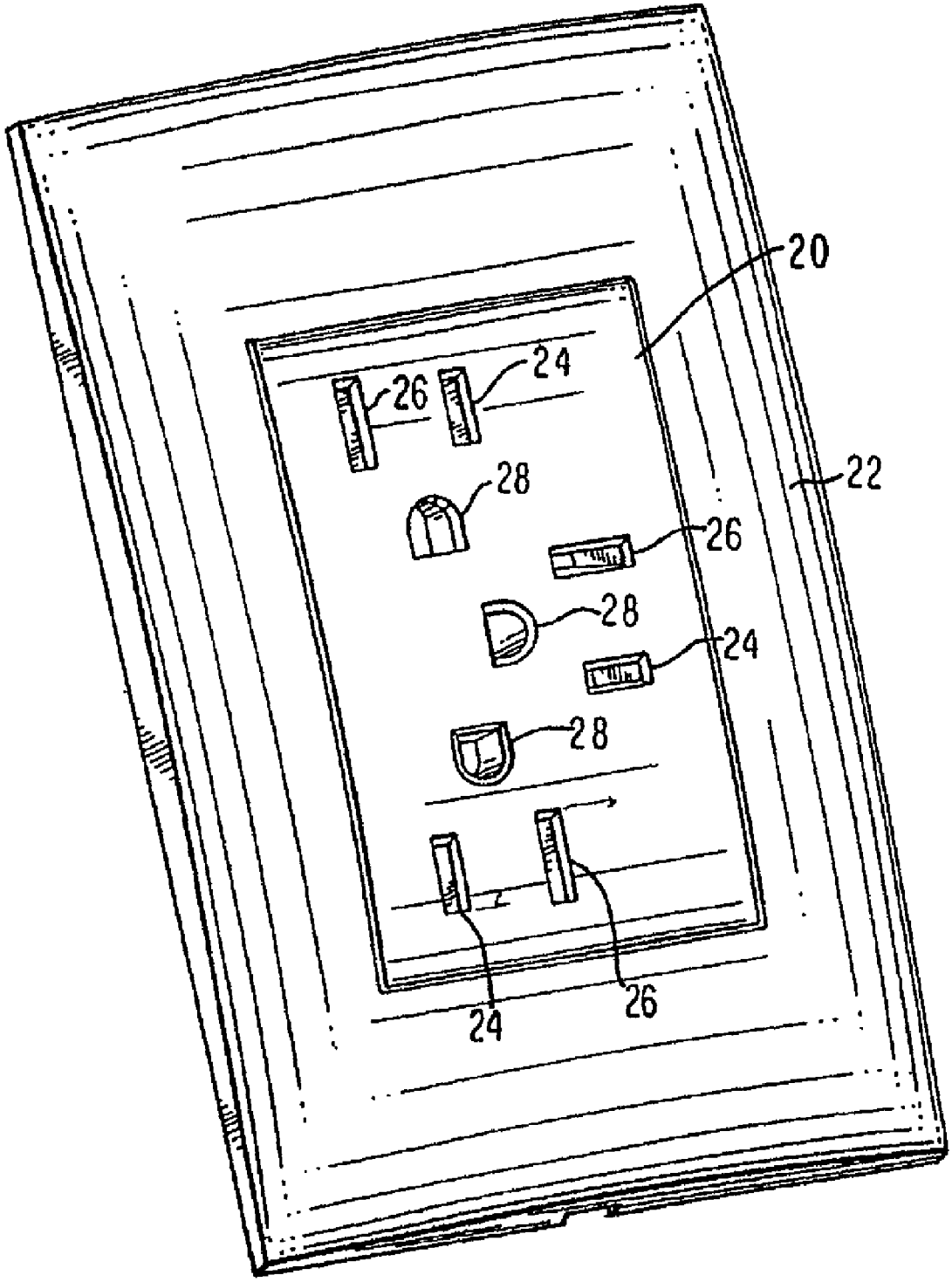
FIG. 1 is an isometric view of a single unit triplex receptacle which can be mounted in a single box and a wall plate in accordance with the principles of the invention.

Referring to FIG. 1, there is illustrated a unitary body configured as a triplex receptacle 20, located within a wall plate 22, in accordance with the principles of the invention. Triplex receptacle 20 is intended for 15 Amp. 125 V AC and according to NEMA specification 5-15R, where each individual receptacle has two slot openings 24 and 26 for receiving the flat blades of a suitable plug and a semi-circular ground blade opening 28. The opening 26 is larger than the opening 24 so that a two blade plug can only be inserted in one way to maintain the correct electrical polarization. The larger slot is connected to the neutral conductor and by maintaining the correct polarization, the external metal parts of appliances such as toasters, TV's etc. can be grounded through the neutral conductor. The presence of the semi-circular ground blade makes insertion with the wrong polarity impossible.

The outlets in triplex receptacle 20 are arranged so that two of the outlets have blade openings 24 disposed along a set of parallel lines, while the third outlet has a blade opening 24 disposed substantially at right angles to those parallel lines. It will be appreciated that such a triplex receptacle may also be configured having its three outlets according to NEMA specifications 5-20R, 6-15R or 6-20R.

Referring to FIG. 2, there is shown an exploded view of a single box 30, a single unit triplex receptacle 44, an attachment plate 42 and cover plate 22. Initially, in the field, a suitable aperture is cut into a wall to provide access for mounting box 30 to a stud 32, or to permit installation of a suitable box to an adjacent stud or directly to the material of the wall (such as plasterboard). The box 30 is a single gem box. The box 30 is made of metal or plastic, has one or more openings in its sides or back to permit the introduction of electrical cables into the interior of the box 30 and has mounting means 34 to permit the box to be anchored to the adjacent stud 32. The box supports pairs of mounting ears 36. Each mounting ear contains a threaded aperture 38 to which can be fastened the mounting screws 44 of the triplex receptacle 20. In the normal order of assembly, electrical cables are passed through knock out openings 40 to the interior of the box. The ends of the electrical cables are stripped of insulation and attached to contacts on the side or rear of the body of the receptacle 20. After the electrical cables are attached to contacts on the side or rear of the body of the receptacle, the body of the receptacle is inserted into the alignment plate 42 and is then pushed into the box until the back of the alignment plate 42 touches the top of the box 30. The receptacle and the alignment plate are now attached to the box by means of screws 44 that pass through clearance openings such as elongated slots 46 in the alignment plate 42 and are threaded into openings 38 in ears 36. Thereafter, wall plate 22 is placed over the assembly of the receptacle 20, the alignment plate 42 and the box 30.

Figure 3:
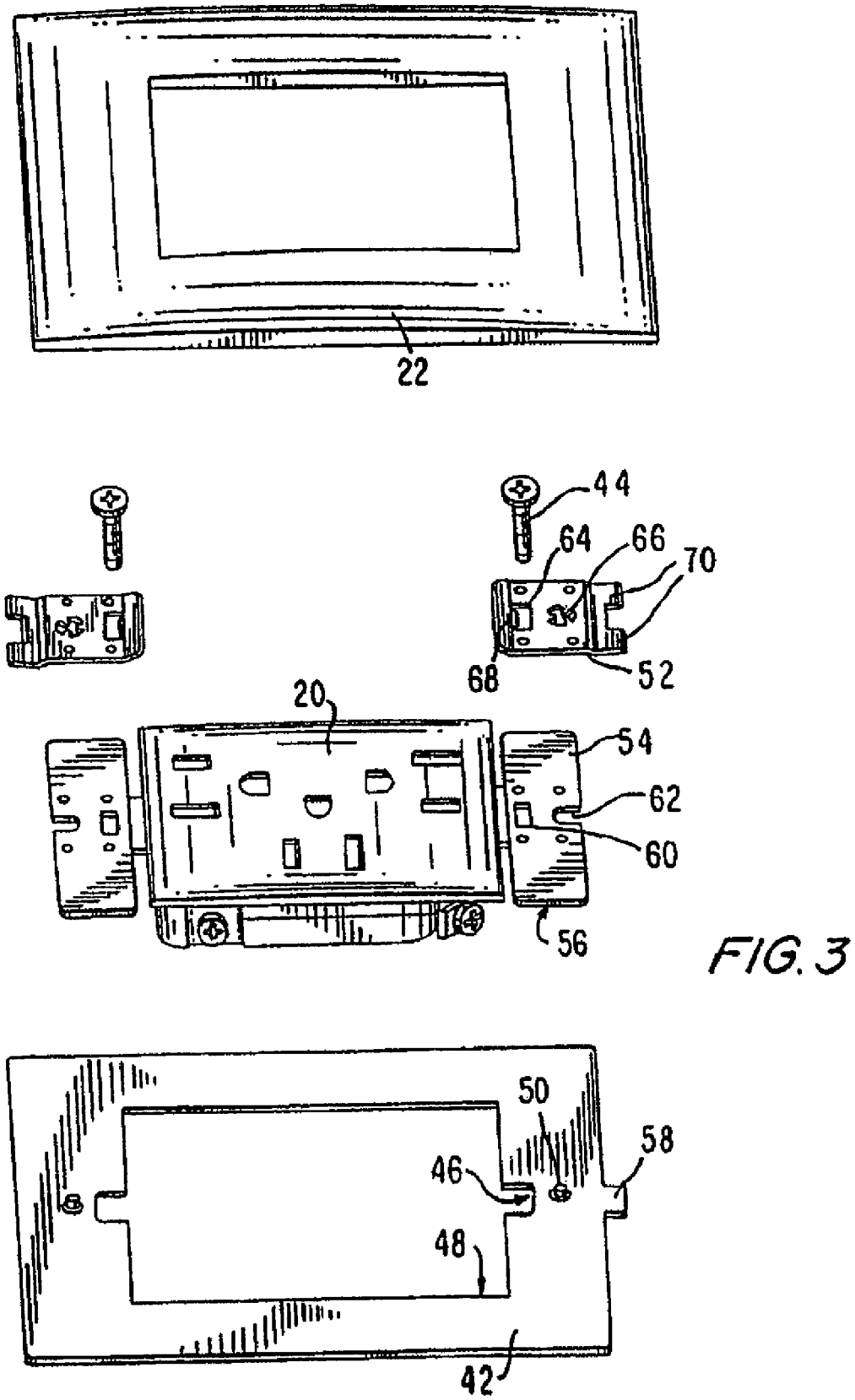
FIG. 3 is an exploded view of the alignment plate, triplex receptacle and wall plate illustrating in detail the captive member attached to the end of the ground strap of the receptacle.

Referring to FIG. 3, the alignment plate 42, which can be composed of metal such as cold rolled steel of the like, supports a centrally located rectangular opening 48 sized to accept the body of the receptacle 20. Centrally located at each end of the rectangular opening and contiguous with the opening 48 are two clearance openings 46 which provide clearance for mounting screws 44 which are used to secure the receptacle 20 and alignment plate 42 to the box. Located beyond the outer edge of each clearance opening 46 is an alignment pin 50. The alignment pins are provided to engage openings 66 located in captive members 52 which are attached to the ends or lugs 54 of the ground strap 56 by screws, rivets etc. Alignment plate 42 supports a tab 58 that projects outward from the lower end and is used to facilitate removal of a wall plate from around the receptacle. The outside dimensions of the alignment plate are such that it can extend beyond at least one dimension of the box to which the receptacle and plate is attached. It is to be noted that the alignment plate 42 illustrated in FIG. 3 is for the single unit triplex receptacle here disclosed.

Continuing with FIG. 3, there is illustrated a new improved single unit triplex receptacle 20 which can fit within a single box. Receptacle 20 supports a ground strap having a lug 54 at each end which is attached to captive members 52 by means of screws, rivets, spot welds or the like. Each lug 54 can be rectangular in shape and contains two openings 60, 62. Opening 60 is a clearance opening for mounting screw 44 which is normally provided by the manufacturer of the receptacle for attaching the receptacle to the box. The distance between centers of openings 60 in lugs 54 on the ground strap is equal to the distance between the centers of openings 38 in ears 36 of box 30 to allow mounting screws 44 in openings 60 to engage and be held captive by the threaded openings 60.

Clearance openings 46 in the alignment plate 42 are clearance openings for mounting screws 44. Openings 62 in the lugs 54 are clearance openings for alignment pins 50 of alignment plate 42.

Continuing with FIG. 3, captive member 52 can be composed of phosphor bronze, spring brass, spring steel or the like and is securely attached to lugs 54. Captive member 52 contains a first opening 64 which is aligned with opening 60 in the lug and a second opening 66 which is aligned with opening 62 in the lug. Opening 60 can be oval, square or rectangular in shape to allow mounting screw 44 to be positioned off center. A centrally located projection 68 extends into opening 64 and is bent at a slight downward angle toward the body of the switch to engage and hold loosely captive the threaded body of mounting screw 44. Engagement of projection 68 with screw 44 provides a good electrical connection between the ground strap of the receptacle, the screw 44 and the box to insure that the receptacle is connected to ground. Screw 44, which passes through opening 64 of the capture member 60 of the lug and opening 46 of the alignment plate 42, threads into opening 38 of the box to hold the receptacle and alignment plate to the box. Openings 64 and 60 are sized to allow the screw 44 to move laterally to compensate for slight misalignments that may occur. Opening 66 in captive member 52 is substantially circular and supports three inwardly projecting members bent upward at a slight angle away from the receptacle body. The ends of the three projecting members form an opening slightly smaller than the diameter of alignment pins 50 on alignment plate 42 and are designed to flex slightly as the alignment pin is inserted into opening 66 from the rear. When the alignment pin is inserted into opening 66, the three ends of the projecting members frictionally engage and hold captive the alignment pins to prevent the easy removal of the alignment pins from the captive member. Located at the end of captive member 52 are two tabs 70. The end of each tab has a double bend similar to a 360 degree sine curve and are provided to hold the wall plate in place by engaging indents on the inside ends of the cover plate.

Figure 4:
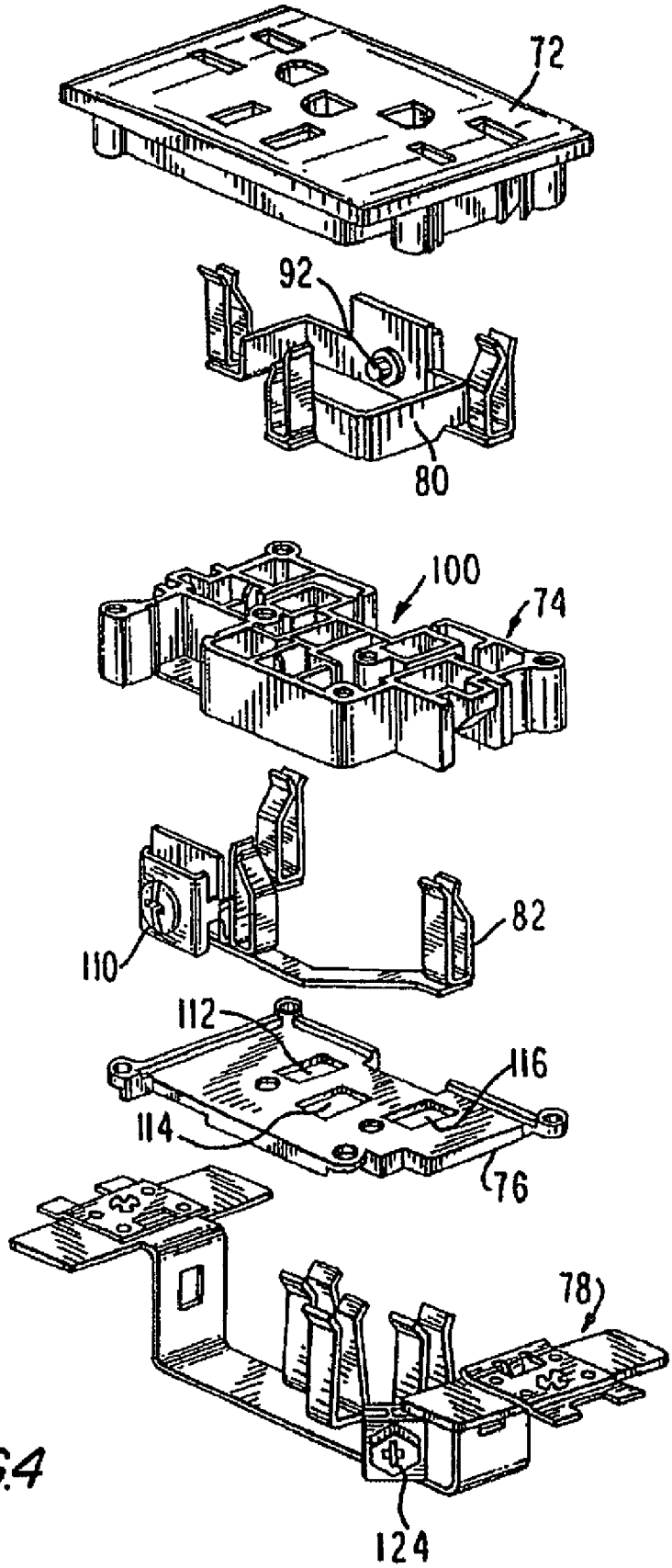
FIG. 4 is an exploded view of the triplex receptacle.

Referring to FIG. 4, there is illustrated an exploded view of the single unit triplex receptacle 20. Receptacle 20 has a top member 72, an intermediate member 74, a bottom member 76 and a ground strap 78. Positioned between the top member and the intermediate member is bus 80 having three contacts, one for each of the three receptacles, for receiving the flat blade of a plug which is to be connected to the neutral conductor. Positioned between the intermediate member and the bottom member is bus 82 having three contacts, one for each of the three receptacles, for receiving the flat blade of a plug which is to be connected to the phase conductor. Positioned below the bottom member 76 is the ground strap 78 having three ground contacts, one for each of the three receptacles, for receiving the ground blade of a plug.

Figure 5:
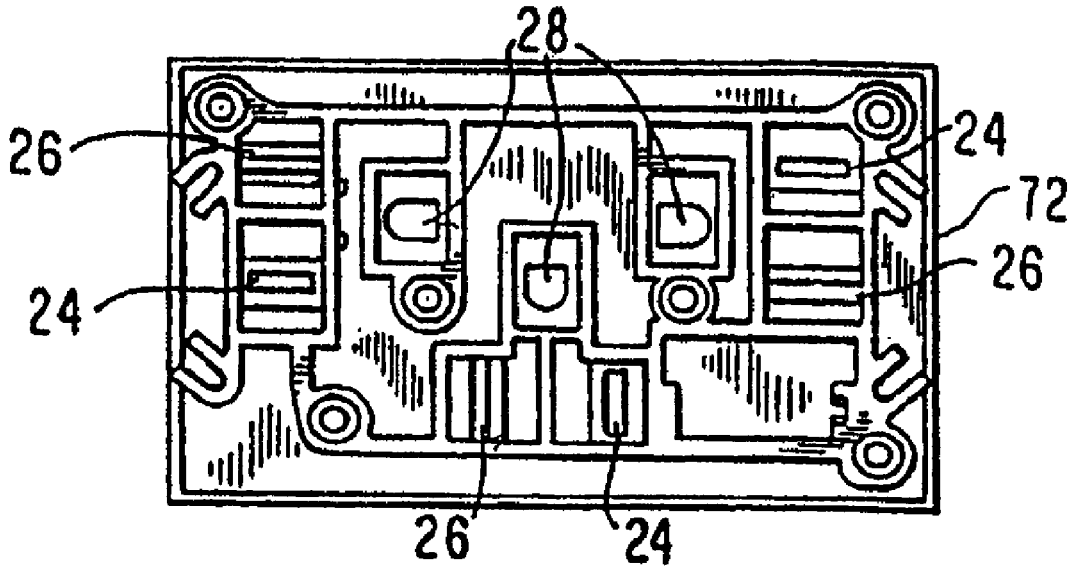
FIG. 5 is a view looking at the top member 72 from bus 80 as shown in FIG. 4.
Figure 6:
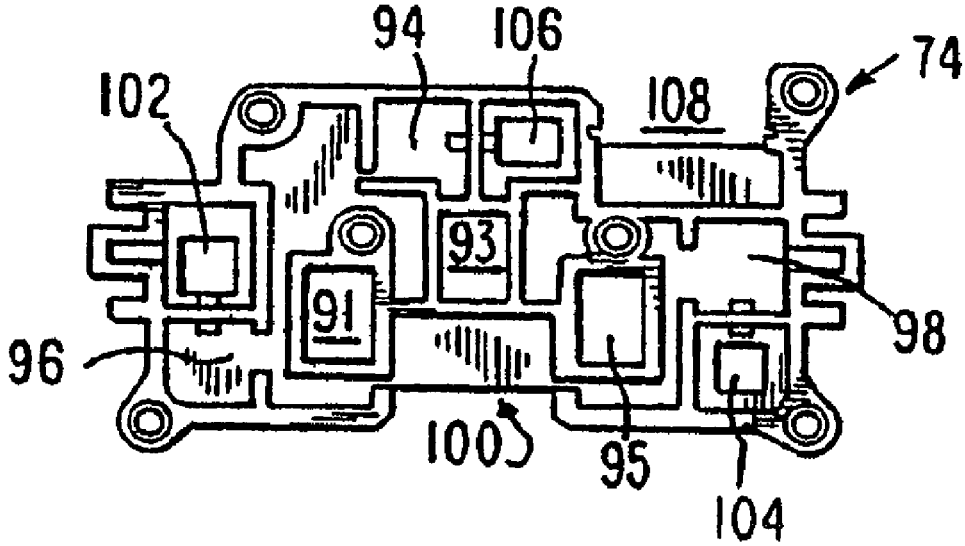
FIG. 6 is a view looking into the intermediate member 74 from bus 80 as shown in FIG. 4.
Figure 7:
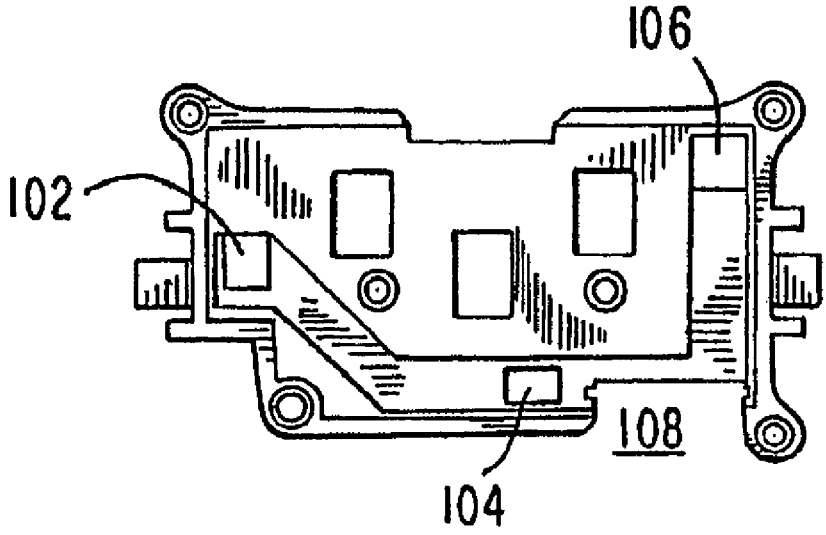
FIG. 7 is a view looking at the bottom of intermediate member 74 from bus 82 as shown in FIG. 4.
Figure 8:
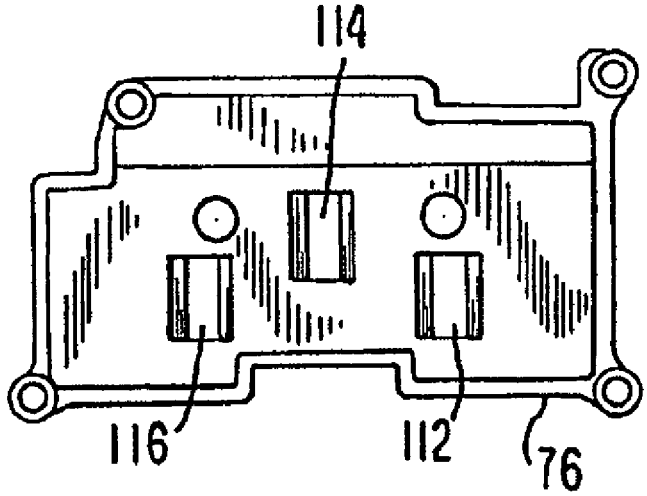
FIG. 8 is a view looking at the top of bottom member 76 from bus 82 as shown in FIG. 4.

FIG. 5 is a plan view of the bottom of top member 72 looking up from bus 80; FIG. 6 is a plan view of the top of intermediate member 74 looking down from bus 80; FIG. 7 is a plan view of the bottom of intermediate member 74 looking up from bus 82; and, FIG. 8 is a plan view of the bottom member 76 looking down from bus 82.

Returning to FIG. 4, bus 80 supports a screw terminal 92 for receiving the neutral wire conductor and three contacts for receiving flat blades of a plug. Intermediate member 74 is composed of insulating material having on its top surface various partitions selectively spaced to provide separate compartments some of which contain openings to provide a serpentine passageway for receiving bus 80. Bus 80 is shaped to follows a serpentine path around and through the various partitions in the top of intermediate member 74 to position the commonly connected three contacts in compartments 94, 96, 98 and screw terminal 92 in opening 100. Referring to FIGS. 5 and 6, when intermediate member 74 is assembled to top member 72, the three contacts of bus 80 are located in compartments 106, 94 and 96 of intermediate member and below the openings 26 of each of the three receptacles in the top member. Referring to FIG. 6, the bottom surface of intermediate member 74 is substantially flat and supports openings 102, 104, and 106 for receiving contacts of bus 82 from the bottom of the member. Intermediate member 74 also contains through openings 91, 93 and 95 for receiving ground contacts on the ground strap 78. Bus 82 supports a screw terminal 110 for receiving a wire conductor. Bus 82 follows a serpentine path along the flat bottom surface of intermediate member 74 to position the commonly connected contacts in openings 102, 104, and 106 and screw terminal in opening 108. Bus 80 is electrically isolated from bus 82 by the insulating bottom surface or floor of intermediate member 74.

Bottom member 76 is adapted to be attached to the bottom of intermediate member 74 and supports openings 112, 114 and 116 for receiving ground contacts. Referring to FIG. 4, when the top, intermediate and bottom members are assembled together, openings 116, 114 and 118 in the bottom member are aligned with openings 95, 93 and 91 respectively in the intermediate member to position the ground contacts behind the ground openings 28 in the top member. In a similar manner, when the receptacle is assembled, openings 104, 106 and 102 are aligned with openings in the top member to position the contacts of bus 82 beneath openings 26 in the top member. Ground strap 78 is composed of conductive material such as iron or steel and is electrically connected to and supports three ground contacts. Ground strap 78 also supports screw terminal 124 for connecting the receptacle ground contacts to an electrical ground.

To assemble the triplex receptacle, the bus 80 and its contacts is placed in the top of intermediate member 74, the bus 82 and its contacts is placed on the bottom of intermediate member, and the intermediate member is then assembled to top member. The bottom member 76 is then positioned next to the bottom of intermediate member over the bus 82 and the ground strap is coupled to the assembled parts. In the assembled receptacle, the contacts which are located behind the openings 24 of each socket are connected to a common bus; the contacts located behind openings 26 of each socket are connected to a common bus; and the contacts located behind the openings 28 of each socket are connected to the ground strap of the receptacle.

To connect the single unit receptacle having three sockets to a box, the electrical cables in a box are stripped of insulation and are attached to terminals on the side or back of the receptacle. The alignment plate is then attached to the receptacle from the back. Initially, after the wires are attached to the receptacle, the alignment plate is held vertically in front of the receptacle and parallel to the receptacle. The top of the receptacle is now tilted downward from its vertical position until it is horizontal and, while in its horizontal position, the end of the receptacle that was initially up is passed through opening 48 of the alignment plate which is in its vertical position. After the receptacle is passed completely through the opening of the alignment plate, the receptacle is tilted back to its initial vertical position. At this time the alignment plate and the receptacle are now moved toward each other until the front face of the alignment plate contacts the back face of the lugs 54 on the ends of the ground strap. As the alignment plate approaches the lugs, alignment pins 50 of the alignment plate pass through openings 62 in the lugs and enter openings 66 in captive members 52. As the alignment pins enter the openings 66, they force the upwardly bent projections to spread apart to allow the alignment pins to fully enter openings 66. The ends of the upwardly bent projections engage and hold captive the alignment pins 50. The receptacle, which is now attached to the alignment plate and is connected to the electrical wires, is inserted into the box. As the receptacle is inserted into the box, screws 44 located in openings 64 of the captive member and clearance opening 46 in alignment plate are aligned with and threaded into openings 38 of the box to hold both the alignment plate and receptacle to the box. The head of screw 44 is larger than opening 64 and 60 and, therefore, holds receptacle 20 and alignment plate 42 captive to the box.

The wall plate is now placed over the receptacle. Referring to FIG. 3, each captive member 52 supports at least two projecting latching pawls 70. Each pawl has a double curve similar to a three hundred sixty degree sine curve. After the receptacle 20 is attached to the alignment plate 42, the two latching pawls 70 of captive member 52 are located on either side of a tab 58 on the alignment plate. Tab 58 functions as a tool pivot point to allow an attached wall plate 22 to be removed from around the receptacle. A slot in the lower edge of the wall plate 22 provides access for the insertion of a small flat tool such as a screw driver to facilitate removal of the wall plate from the receptacle.

Figure 9:
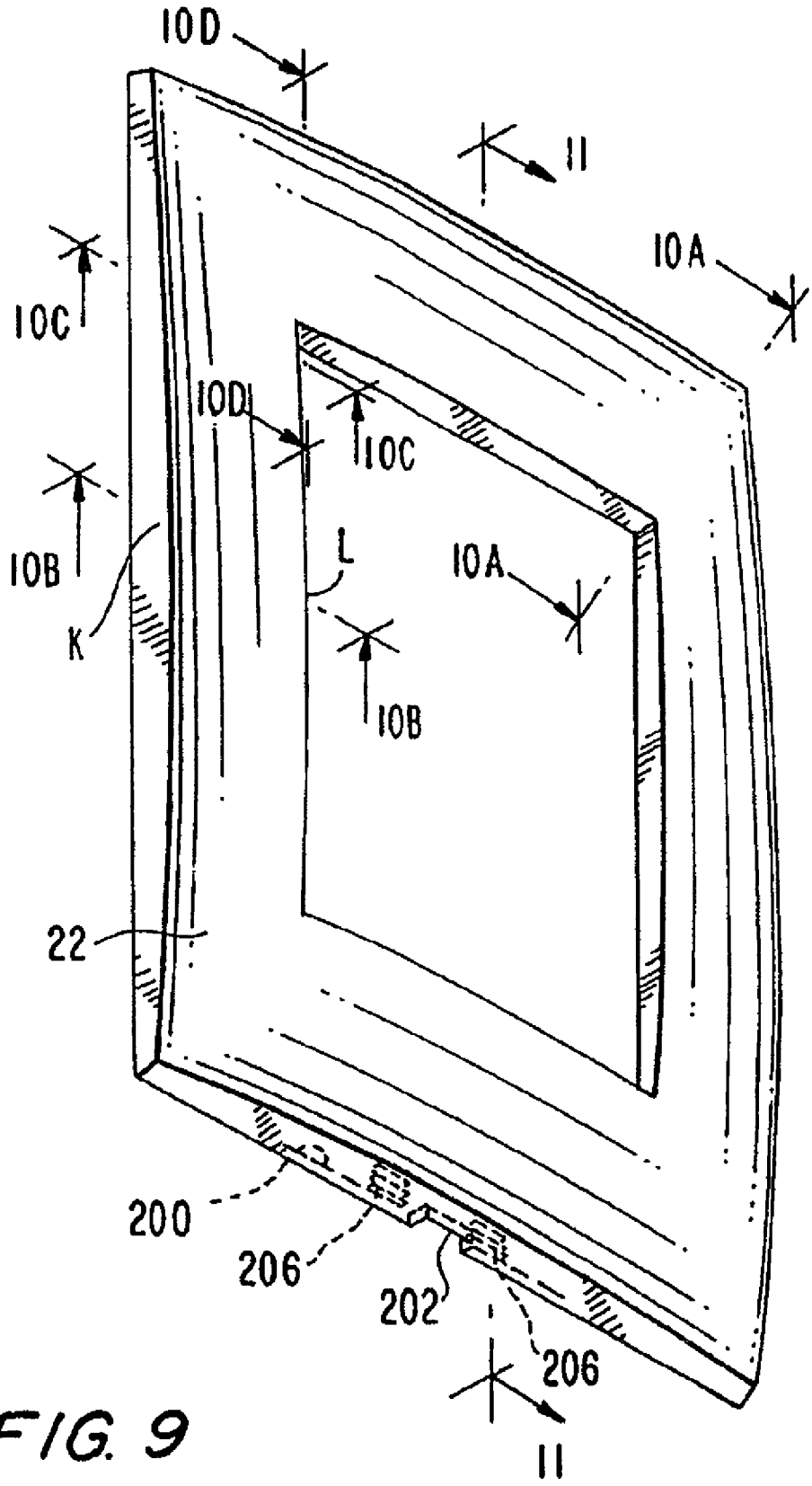
FIG. 9 is a front perspective view of the wall plate.
Figure 11:
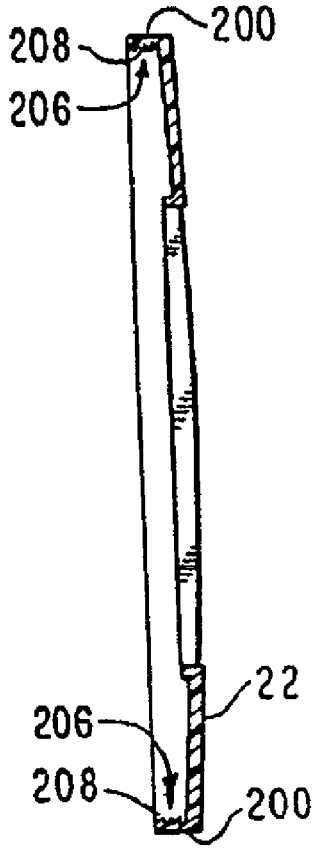
FIG. 11 is a side elevation sectional view of the wall plate taken along the line 4-4 of FIG. 9.
Figure 12:
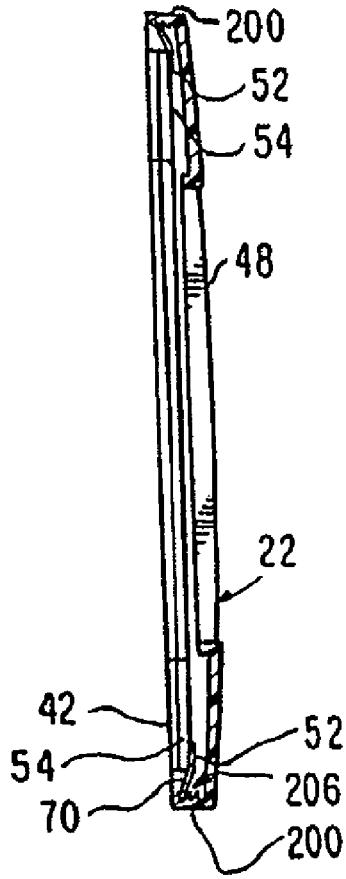
FIG. 12 is a side elevation, partially is section of the wall plate as shown in FIG. 9 installed on a ground strap and alignment plate.

The width of the face of the single unit receptacle having three sockets is approximately 60% of the width of the cover plate (see FIG. 9) along the horizontal axis and approximately 53% of the length of the wall plate along the vertical axis. For the triplex receptacle, the wall plate is substantially 4.92 inches in length by 3.28 inches in width and has a rectangular opening for receiving the receptacle that is substantially 2.82 inches in length by 1.83 inches in width. The width of the wall plate varies depending upon how many boxes are ganged together and the number of triplex receptacles that are to be located in side-by-side relationship in boxes that are ganged. The front surface of the wall plate has a complex contoured shape where the edge of the wall plate at the rectangular opening for a triplex receptacle is further from the wall than the outer edge of the cover plate. More specifically, referring to FIG. 10, there is illustrated a view along the line B-B of FIG. 9 of a portion of the front surface, along the horizontal centerline, between point K, the outer right edge, and point L, the inner edge of the opening for the receptacle. As illustrated in FIG. 10, the surface lies between two profile boundaries 0.002 inches apart, perpendicular to datum plane A, equally disposed about the true profile and positioned with respect to a datum plane. The basic dimensions and the profile tolerance establish a tolerance zone to control the shape and size of the surface. The surface is 0.726 inches in length. Within that length, a contour is defined by the dimensions of equidistant points which are 0.0726 inches apart. Each dimension indicates that point's distance to define datum plane A, the back (flat) surface of the cover plate, which begins at point K. Moving from left to right, the dimensions increase from 0.228 to 0.287 inches. This progression indicates a contour of increasing height, positive first differential, when the points are connected by individual splines. The points are not connected by a single arc and the rate at which the contour height increases is not constant. The rate of height increase of the individual splines decreases from left to right, and the second differential of the contour is negative. That is, the difference between the first point's distance dimension and the second is larger than the difference between the second and the third, etc. Thus, the surface has a contour of positive first differential and negative second differential, comprised of a combination of splines drawn between points of varying distance from a datum plane. This description substantially describes most of the wall plate's contours for sections along lines 10A-A, D-D, and E-E of FIG. 9. Section along line C-C, which runs along the vertical centerline of the wall plate defines a surface having a positive first differential and zero second differential, comprised of a combination of splines drawn between points of varying distance from a datum plane. This contour has zero second differential because the rate of height increase of the individual splines is constant; the difference between any two sequential point dimensions is at a uniform spacing of 0.0037 inches.

The contour along the width of the front of the triplex receptacle face is flat and the contour along the length of the triplex receptacle has a constant radius of substantially 30.724 inches. The shape of the front of the receptacle face allows for the proper seating of an inserted plug. The wall plate has no exposed mounting screws or other visible metal hardware. When the wall plate is attached to the receptacle, the only visible parts are the wall plate 22 and the receptacle.

Figure 13:
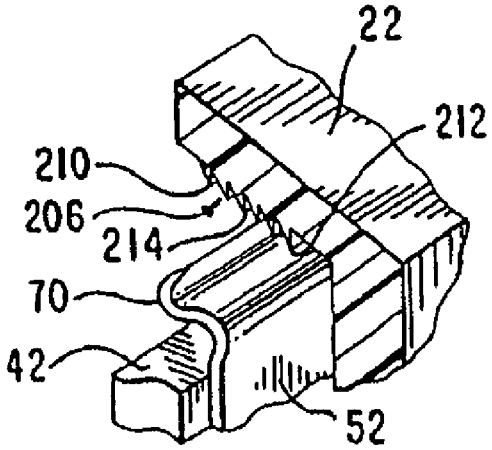
FIG. 13 is a fragmentary enlarged side elevation of the latching pawl of the captive member engaging the saw-tooth rack of the wall plate.
Figure 14:
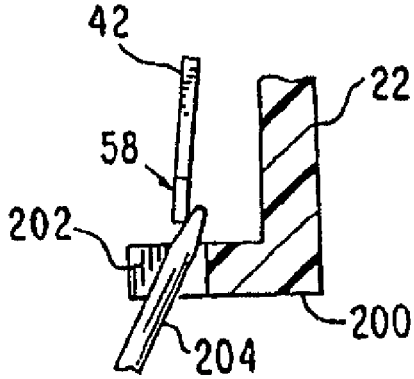
FIG. 14 is a fragmentary, enlarged side elevation in section of the wall plate and tab of the alignment plate to indicate how the two components can be separated following latching.

Referring to FIGS. 11-14, placed in the bottom end wall 200 of wall plate 22 is a slot 202 which provides access to the tab 58 on the alignment plate as seen in FIG. 14. A small, flat tool blade such as a screw driver blade 204 is moved through slot 202 in end wall 200 to contact both the outer surface of tab 58 and the back wall of slot 202. By moving the blade 204 in a counterclockwise direction using the back wall of slot 202 as a fulcrum, the force applied to tab 58 will separate wall plate 22 from the receptacle. To attach wall plate 22 to the receptacle, the pawls 70 of captive member 52 are made to engage saw-tooth shaped racks 206 located on the inner surfaces of the end walls 200 of wall plate 22. There are two racks on the top and bottom end walls 200. Each rack 206 contains a number of saw-tooth shaped teeth 208 each having an inclined front face 210 and a vertical back face 212. As seen in FIG. 13, as latching pawl 70 engages the inclined front face 210, the pawl deflects in a counterclockwise direction and moves past the tip of the first tooth 214. Once pawl 70 is past the tip of tooth 214, it can return to its initial position and take a position between the vertical back face 212 of first tooth 214 and the inclined front face 210 of a second tooth 214. This operation can be repeated as many times as needed to position the bottom edges of wall plate 22 as close to the wall as possible. Since each of the racks 206 and pawls 70 are independently operated, it is possible to locate the wall plate 22 to closely follow the wall contour, even when the wall is not flat. This ability to follow the wall contour is even more appreciated where the wall plate 22 is large, such as with a wall plate that is required to cover four ganged boxes where a receptacle is located in side by side relationship with switches.

Once the latching pawl 70 returns to its original position, any attempt to dislodge the wall plate 22 from the pawl 70 which is mechanically attached to the receptacle becomes difficult. However, since tool 204 can apply a great deal of force to tab 58, it is possible to separate the pawl 70 from engagement with the teeth and thus the receptacle from the cover plate.

Figure 15:
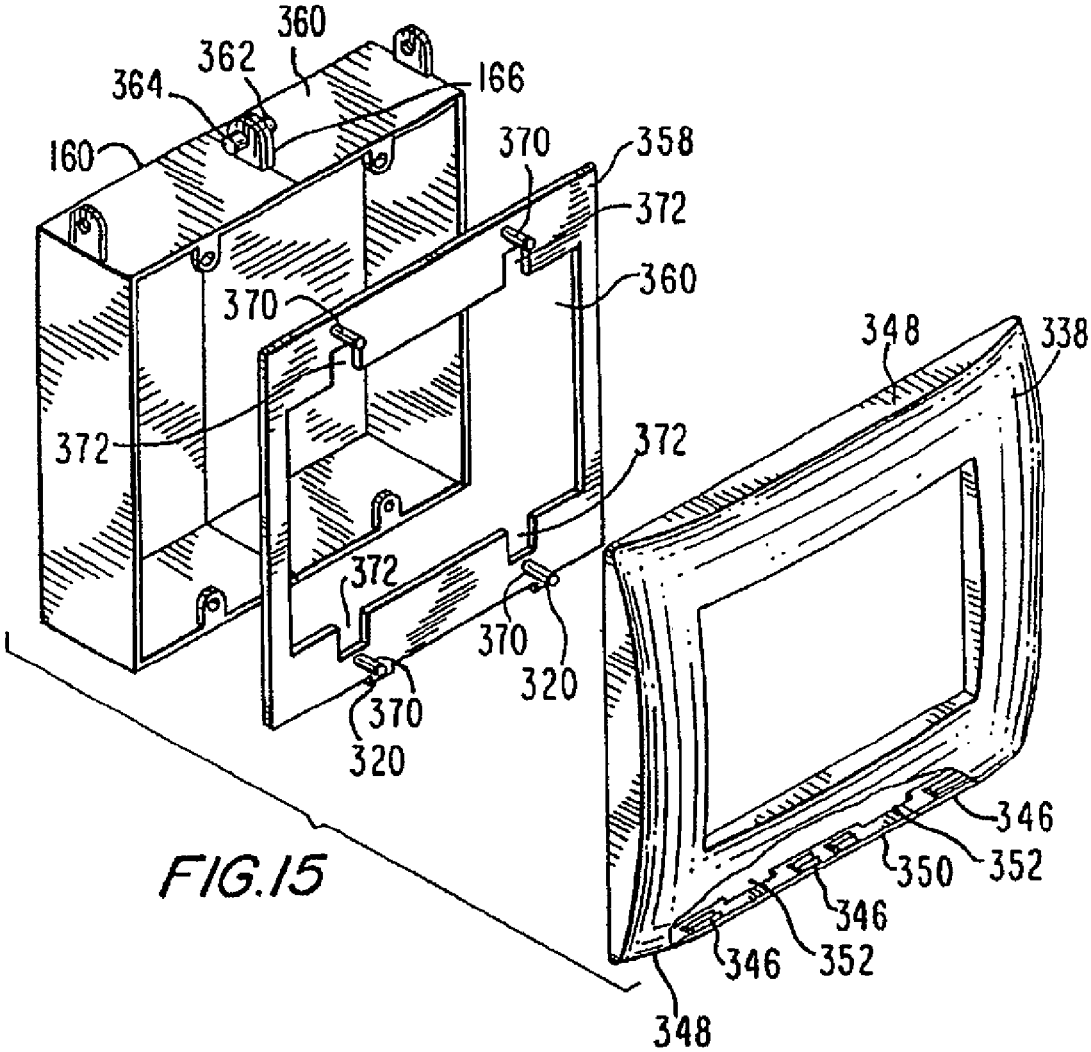
FIG. 15 is an exploded view of a ganged box, a wall plate and alignment plate for a receptacle having four, five or six outlets, in accordance with embodiments of the invention.

Referring to FIG. 15, there is illustrated two boxes joined together to provide a double box, an alignment plate 358 and a wall plate for two triplex receptacles positioned side by side in the double box. It is to be noted that there is no partition or dividing member located in the wall plate opening to separate the two receptacles. Accordingly, the double box 360 may be viewed as a single housing for the receptacle. In different embodiments of the invention, the receptacle may have four, five or six outlets accommodated in the single housing. In an embodiment, a sixplex receptacle having six outlets is provided in the box. The sixplex receptacle may be formed from two triplex receptacles arranged symmetrically, as detailed below.

Two triplex receptacles can be placed in the double ganged box 360 (shown in FIG. 15), which is made up of two single ganged boxes and joined by fasteners 362 extending through the threaded apertures 364 of two joining ears 166. Alignment plate 358 has a single opening 360 for receiving two triplex receptacles, four clearance openings 372 and four alignment pins 370.

Looking at the wall plate 338, there can be three racks 346 on the interior of the top and bottom end walls 348 for receiving four pawls where the center rack is sized to receive one pawl from each receptacle. Also, there can be two tabs 320, one for each triplex receptacle, which will be accessible via slots 352 in the bottom end wall 348 of wall plate 338. Because of the independent operation of the pawls of the captive members with their respective racks 346, the wall plate 338 is able to compensate somewhat for lack of flatness of the wall around the receptacle.

Figure 16:
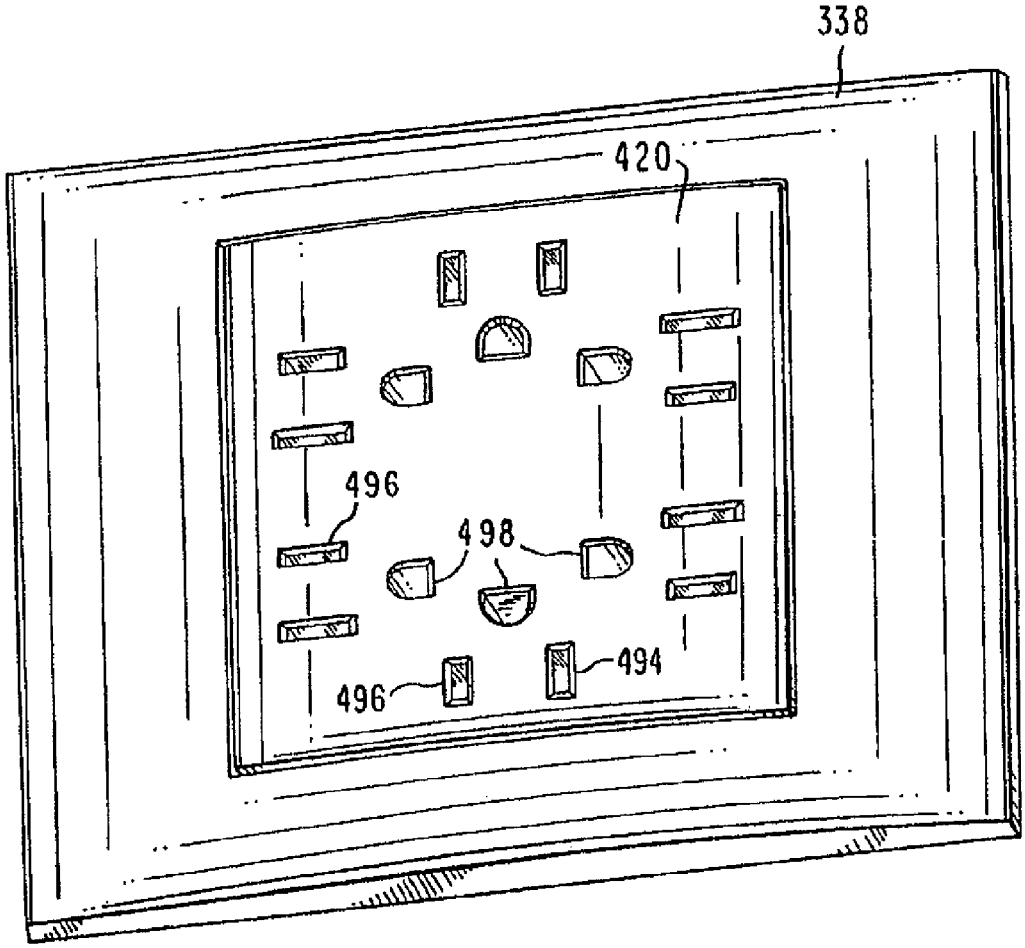
FIG. 16 is an isometric view of a unitary body having six outlets (a single unit sixplex receptacle) and a wall plate in accordance with an embodiment of the invention.

Referring to FIG. 16, there is illustrated an isometric view of a unitary body configured as a receptacle 420 having six outlets, in accordance with the principles of the invention. As with the triplex receptacle, the sixplex receptacle 420 is intended for 15 Amp. 125 V AC and according to NEMA specification 5-15R, where each individual receptacle has two flat blade openings 424 and 426 for receiving the flat blades of a suitable plug and a semi-circular opening 428 for a ground blade. The opening 426 is larger than the opening 424 so that a two blade plug can only be inserted in one way to maintain the correct electrical polarization. The larger slot is connected to the neutral conductor and by maintaining the correct polarization, the external metal parts of appliances such as toasters, TV's etc. can be grounded through the neutral conductor. The presence of the ground blade makes insertion of a plug with the wrong polarity impossible.

Figure 17:
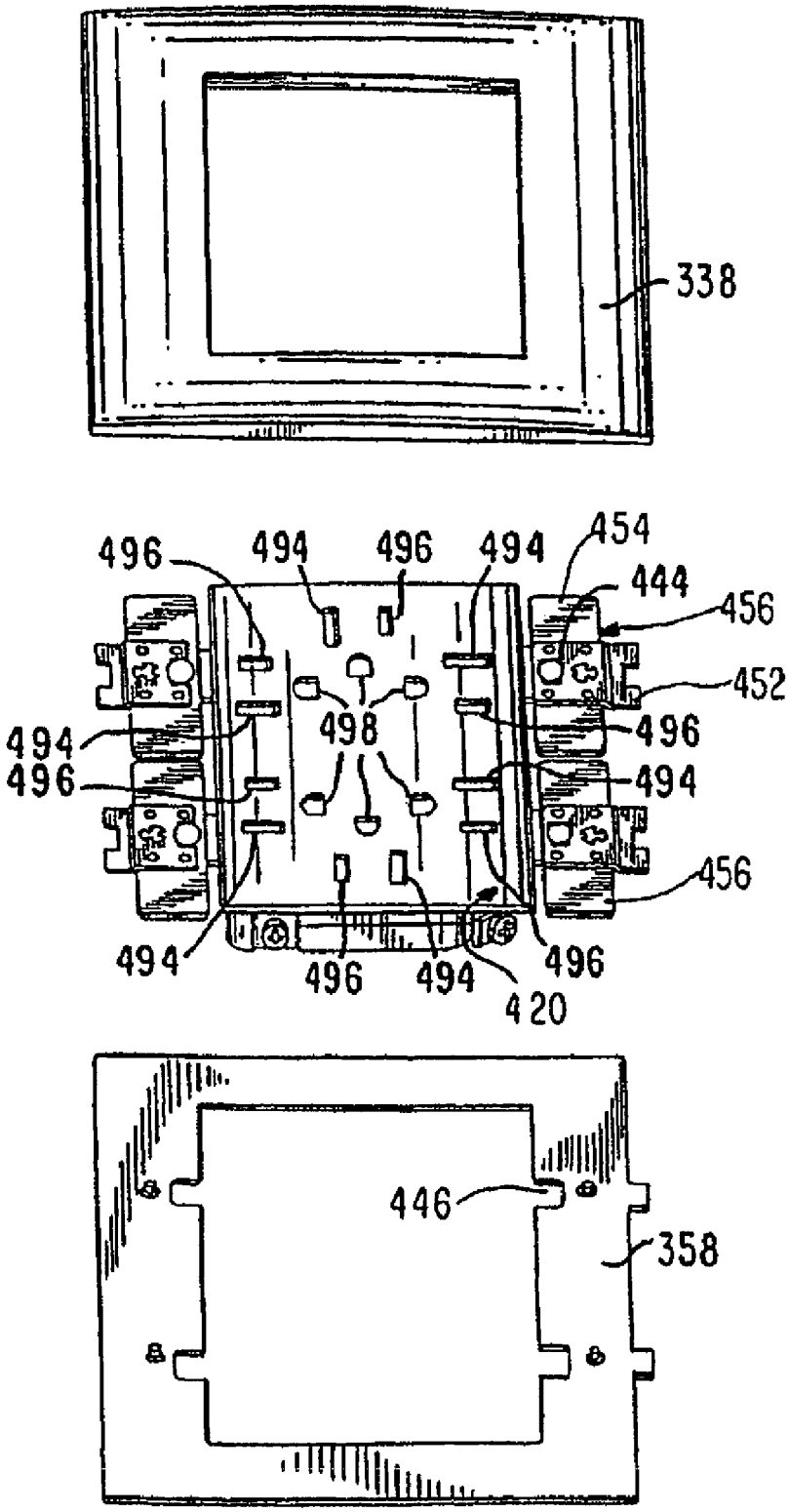
FIG. 17 is an exploded view of the alignment plate, a sixplex receptacle and a wall plate.

Referring to FIG. 17, there is illustrated an exploded view of the sixplex receptacle, and the alignment plate 358 and the wall plate 338 for the sixplex receptacle. Initially, during installation, a suitable aperture is cut into a wall to provide access for two boxes (see FIG. 15) joined together to form a single double size box mounted to a stud, or to permit installation of a suitable box to an adjacent stud or directly to the material of the wall (such as plasterboard). The double box consists of two single gem boxes joined together. The double box is large enough to accept a single unit sixplex receptacle having six outlets as disclosed herein. The box is made of metal or plastic, has one or more openings in its sides or back to permit the introduction of electrical cables into the interior of the box and has mounting means to permit the box to be anchored to an adjacent stud. The box supports pairs of mounting ears each having a threaded aperture to which is fastened the mounting screws of the receptacle 420. During assembly, electrical cables are passed through knock out openings to the interior of the box. The ends of the electrical cables are stripped of insulation and attached to contacts on the side or rear of the body of the receptacle 420. After the electrical cables are attached to contacts on the side or rear of the body of the receptacle, the receptacle is attached to the top side of the alignment plate 358, and the body of the receptacle is pushed into the box until the alignment plate 358 touches the top of the box. At this time, the receptacle and the alignment plate are attached to the box by means of screws 444 that pass through clearance openings such as elongated slots 446 and threaded into openings in ears of the box to mount receptacle 420 to the box. Thereafter, wall plate 338 is placed over the receptacle 420, the alignment plate 358 and the box.

Referring to FIG. 17, the alignment plate 358 and the wall plate 338 shown is for use with a single unit receptacle having six sockets and are similar to the alignment plate and wall plate shown in FIG. 15. Continuing with FIG. 17, there is illustrated a new improved single unit receptacle 420 having six sockets which can fit within a double box. The sixplex receptacle 420 supports two ground straps 456 each having a lug 454 at each end which provides support for captive members 452 by means of screws, rivets, spot welds or the like. Each ground strap 456 with its captive member 452 is similar to the ground strap and captive member shown in FIG. 3 and, therefore, in the interest of brevity, the details of their construction and operation will not again be repeated.

Figure 18:
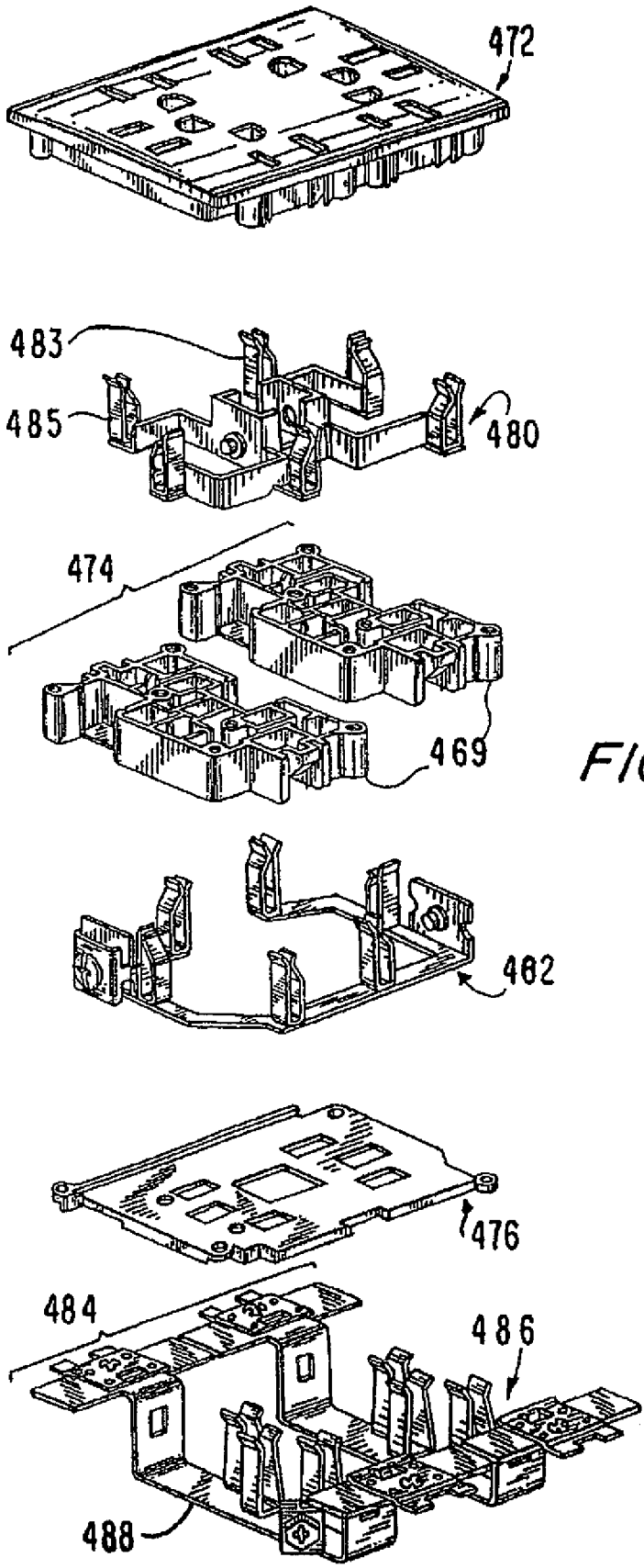
FIG. 18 is an exploded view of the sixplex receptacle.

Referring to FIG. 18, there is illustrated an exploded view of a sixplex receptacle having a top member 472, intermediate member 474 consisting of two sections 469, a bottom member 476 and a ground strap 484 consisting of two sections 486 and 488. Positioned between the top member 472 and the two intermediate members is bus 480 having a six contacts, one for each of the six sockets in the top member for receiving the flat blade of a plug which is to be connected to a neutral conductor. Positioned between the two intermediate members 474 and the bottom member 476 is bus 482 having six contacts, one for each of the six sockets for receiving the flat blade of a plug which is to be connected to a phase conductor. Positioned below the bottom member 476 is the ground strap 484 consisting of two sections 486, 488 which are electrically connected together and support six ground contacts, one for each socket for receiving the ground blade of a plug which is to be connected to ground.

The top member 472 of the sixplex receptacle is a single structure having, on its top surface, six sockets each of which contains three openings, one for the phase line, one for the neutral line, and one for the ground line. The top member of the sixplex receptacle can be considered to be two top members 72 of the triplex receptacle (see FIG. 4) joined together to form a single member. Thus, the bottom surface of the top member 472, looking up from bus 480 is similar to the bottom surface of two top members joined together to form a single unit and, thus, supports partitions selectively positioned to provide compartments which communicate with the openings of the various sockets in the top surface and provides passageways for accommodating the bus 480 having six contacts. Thus, the top member 472 of the sixplex receptacle can be considered to be two top members of the triplex receptacle shown in FIG. 4 positioned side by side and molded as a single unit. Continuing with FIG. 18, intermediate member 474 consists of two individual sections 469 each of which is similar to intermediate section 74 of the triplex receptacle shown in FIG. 4.

Bus 480 consists of two sections 483 and 485 electrically connected via a conductive bridge where each section is similar to bus 80 of the triplex receptacle shown in FIG. 4. Each section of bus 480 supports a screw terminal 492, either of which can be connected to a wire conductor. The bus is also connected to six contacts for receiving the flat blades of a plug which are to be connected to the neutral conductor. Each section 469 of intermediate member 474 is similar to intermediate member 74 of the triplex receptacle and, thus, the top of each section 469 contains various partitions selectively spaced to provide a serpentine passageway for receiving the bus 480 having six contacts. More specifically, bus 480 follows a serpentine path around and through the various partitions in the top of sections 469 to position the commonly connected contacts in openings which communicate with openings in the top member 472 designated to receive the flat blade of a plug which is to be connected to the neutral conductor 494. As with intermediate member 74, the bottom surface of each section 469 of intermediate member 474 is substantially flat and supports openings for receiving six contacts of the phase bus 482. Bus 482 can be considered to consist of two halves where each half is similar to bus 82 of the triplex receptacle shown in FIG. 4. The two halves of bus 482 are connected together by a conductive bridge and supports six contacts for receiving flat blades which are to be connected to the phase conductor. Bus 482 also supports two screw terminals either of which can be connected to the phase conductor. Bus 482 follows a serpentine path along the flat bottom surface of the two sections of intermediate member 474 to position the commonly connected contacts below openings in the member 470 designated to receive the flat blade of a plug which is to be connected to the phase conductor. Bus 480 is electrically isolated from bus 482 by the bottom surfaces of the two sections of intermediate member 474.

Bottom member 476 is a single member similar to the two bottom members 76 of the triplex receptacle and joined together to form a single member. Member 476 is adapted to fit over the bottom of the two sections of intermediate member 474 and contains six openings for receiving the six contacts of the ground strap 484. Ground strap 484 consists of two sections 486 and 488, each of which is similar to the ground strap 78 of the triplex receptacle and connected together by a conductive bridge. Ground strap 484 supports six ground contacts which are positioned to fit in various openings in the different members of the receptacle which allow the ground contacts to be positioned below openings in the top member 470 designated to receive the half-round blade of a plug which is to be connected to ground. The ground strap 478 supports two screw terminals, either of which can be connected to an electrical ground.

Assembly of the sixplex receptacle is basically similar to the assembly of the triplex receptacle. The main difference is that the assembled sixplex receptacle is connected to two boxes ganged together instead of one box and the alignment plate and wall plate (see FIG. 15) are sized to accommodate the sixplex receptacle. In addition, the various buses and top, intermediate and bottom members of the sixplex receptacle are sized to provide a receptacle having six sockets rather than three sockets.

Figure 19:
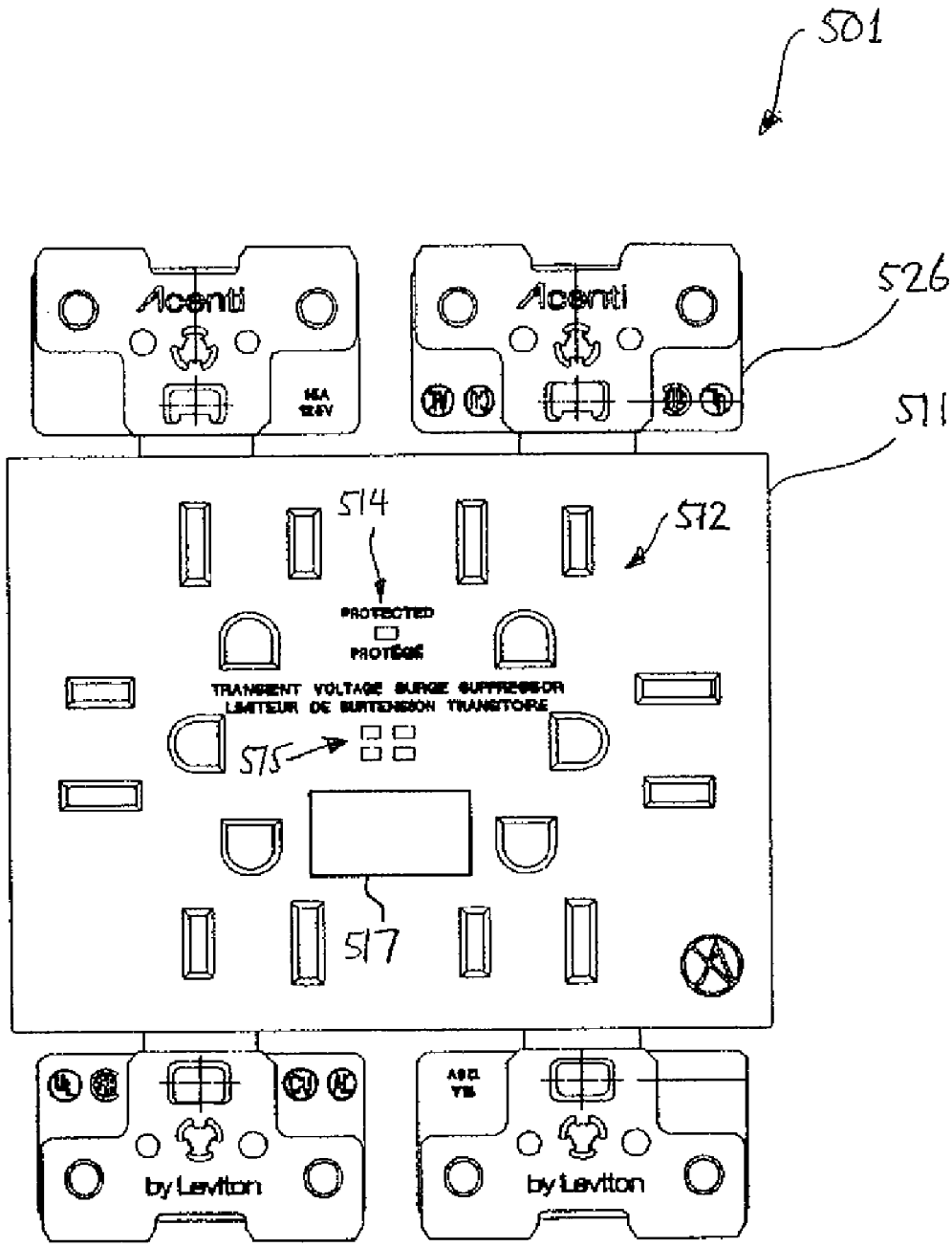
FIG. 19 is a plan view of a sixplex receptacle including a TV SS with a visual indicator and audible alarm, in accordance with an embodiment of the invention.

FIG. 19 shows the front face of a sixplex receptacle 501 integrating a protective circuit and visual and audible indicator devices, constructed in accordance with another embodiment of the invention and suitable for mounting in a double box. The front cover assembly 511 has six sets of holes therein for receiving six plugs. As shown in FIG. 19, sixplex receptacle 501 is intended for 15 Amps, 125 V AC and according to NEMA specification 5-15R, where each individual socket 512 has two flat blade openings for receiving the flat blades of a suitable plug and a semicircular opening for a ground blade. One of the flat blade openings is larger than the other so that a two-blade plug can only be inserted in one way, to maintain the correct electrical polarization. The larger opening is connected to the neutral conductor; by maintaining the correct polarization, the external metal parts of appliances such as toasters, TVs, etc. can be grounded through the neutral conductor. The presence of the ground blade makes insertion of a three-blade plug with the wrong polarity impossible. A ground blade of a three-blade plug makes contact with a ground conductor connected to ground strap assembly 526, described in more detail below. It will be appreciated that the sixplex receptacle of FIG. 19 may also be configured with its outlets according to NEMA specifications 5-20R, 6-15R or 6-20R.

In this embodiment, sixplex receptacle 501 has integrated therein a transient voltage surge suppressor (TVSS). An opening 514 on the front face of cover assembly 511 transmits light from an LED in the TVSS circuit; the light provides a visual indication that the TVSS is working and is capable of protecting appliances against voltage surges. The TVSS circuit also includes an alarm buzzer mounted behind openings 515; the alarm sounds if the TVSS fails (due to a large overvoltage or for some other reason). Additional details of the TVSS circuit in this embodiment are given below.

Figure 20:
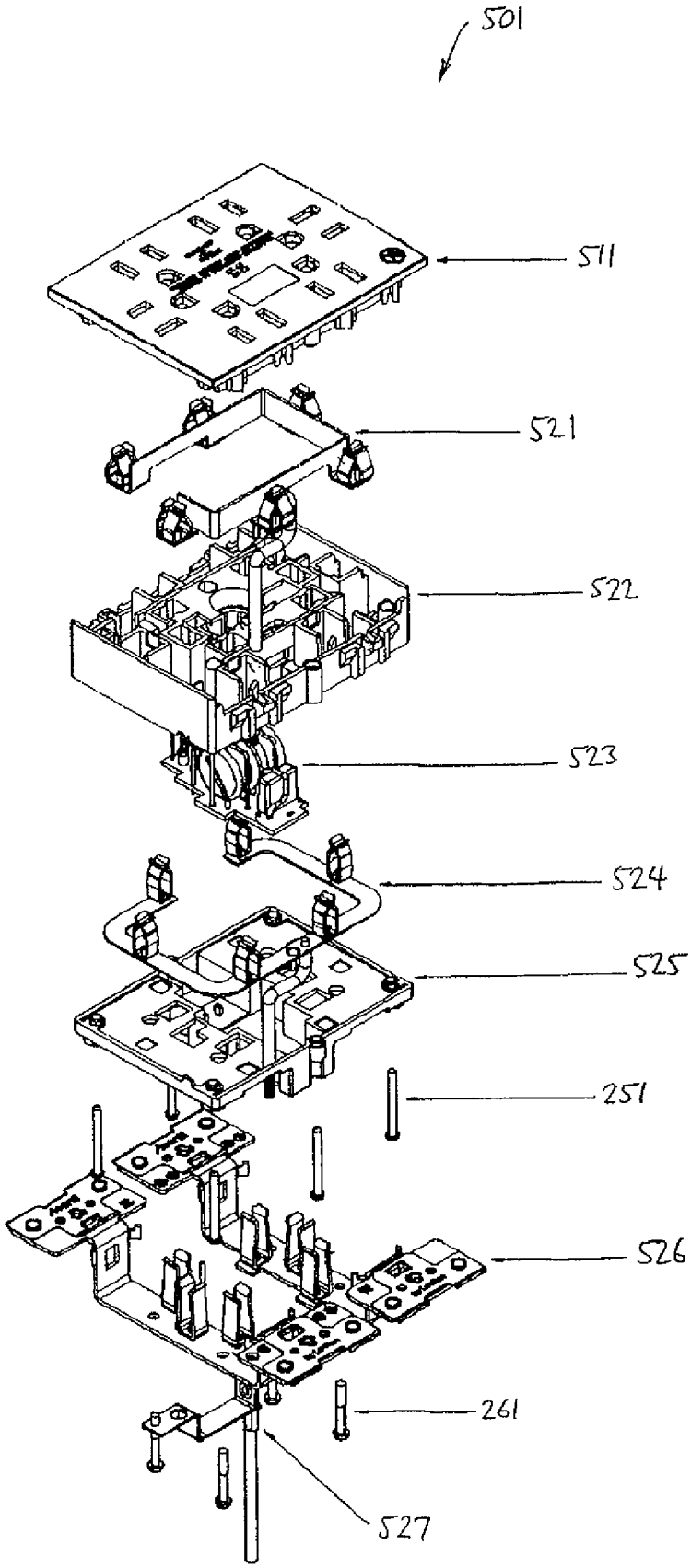
FIG. 20 is an exploded view of a sixplex receptacle including a TVSS in accordance with an embodiment of the invention.

Referring to FIG. 20, there is illustrated an exploded view of sixplex receptacle 501 having a front cover assembly 511, a center assembly 522, a back cover 525 and ground straps 526 connected by ground bridge assembly 527. Positioned between the cover assembly 511 and the center assembly 522 is a neutral bus assembly 521 having six contacts, one for each of the six openings in the front cover assembly for receiving the flat blade of a plug which is to be connected to a neutral conductor. Positioned between the center assembly 522 and the back cover 525 is a line bus assembly 524 having six contacts, one for each of the six openings for receiving the flat blade of a plug which is to be connected to a line conductor. Positioned below the back cover 525 are the ground strap assemblies 526, which are electrically connected together and support six ground contacts, one for each of the six openings for receiving the ground blade of a plug which is to be connected to ground. A printed circuit board (PCB) 523, having the TVSS device mounted thereon, is positioned beneath center assembly 522 so that the TVSS components are surrounded by the center assembly. Screws 251 connect the back cover 525 with the front cover assembly 511 through holes in the center assembly 522. The ground bridge assembly 527 is secured to the ground strap assemblies 526 and to the back cover 525 by pins 261.

As shown in FIG. 20, the top of center assembly 522 contains various partitions selectively spaced to provide a serpentine passageway for receiving neutral bus assembly 521 and the contacts connected thereto. The contacts are thus positioned to communicate with the openings in front cover assembly 511 to receive the flat blade of a plug to be connected to a neutral conductor. Line bus assembly 524 follows a serpentine path along the bottom surface of center assembly 522. Center assembly 522 also has six openings for receiving six contacts connected to line bus assembly 524, which are positioned to communicate with the openings in front cover assembly 511 to receive the flat blade of a plug to be connected to a line conductor. Line bus assembly 524 and neutral bus assembly 521 are electrically isolated from each other by the bottom surface of, and the partitions in, center assembly 522.

Back cover 525 is adapted to fit over the bottom of center assembly 522 and contains six openings for receiving six contacts connected to ground strap assemblies 526. Each ground strap has three contacts connected thereto, positioned to fit through openings in the center assembly so as to communicate with the openings in the front cover assembly 511 to receive the half-round blade of a plug which is to be connected to ground.

Figure 21:
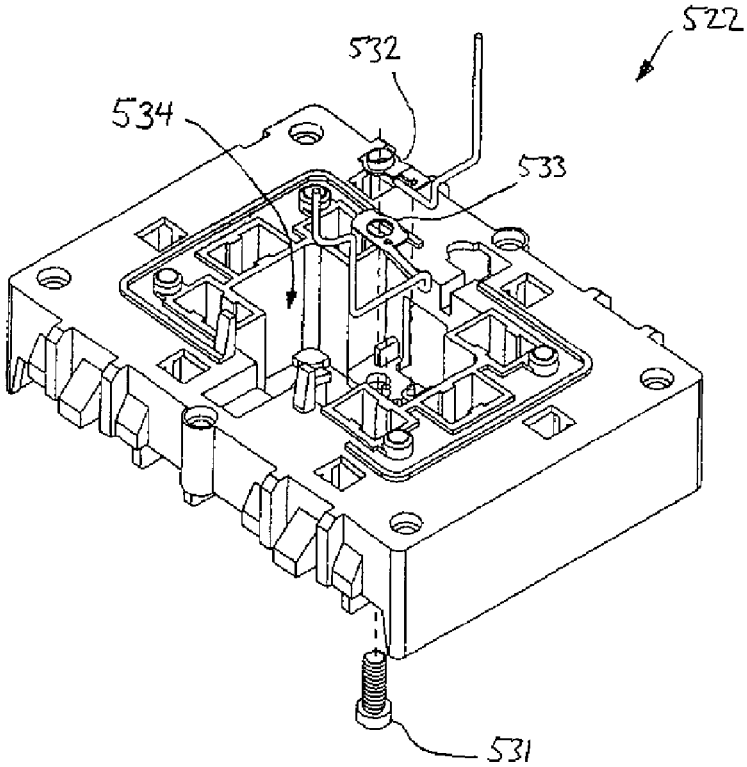
FIG. 21 shows details of a middle housing assembly of a sixplex receptacle according to an embodiment of the invention.

FIG. 21 is another view of center assembly 522, showing the bottom surface thereof. A screw 531, of an insulating material such as nylon, connects wire leads 532 and 533 and secures them to the center assembly; the wires are connected to the alarm buzzer of the TVSS device. Tightening screw 531 brings the leads into electrical contact, while loosening the screw breaks contact between the leads, thereby disabling the alarm. PCB 523, with the TVSS circuit components, is positioned in a cavity 534 in the center of assembly 522.

Figure 22:
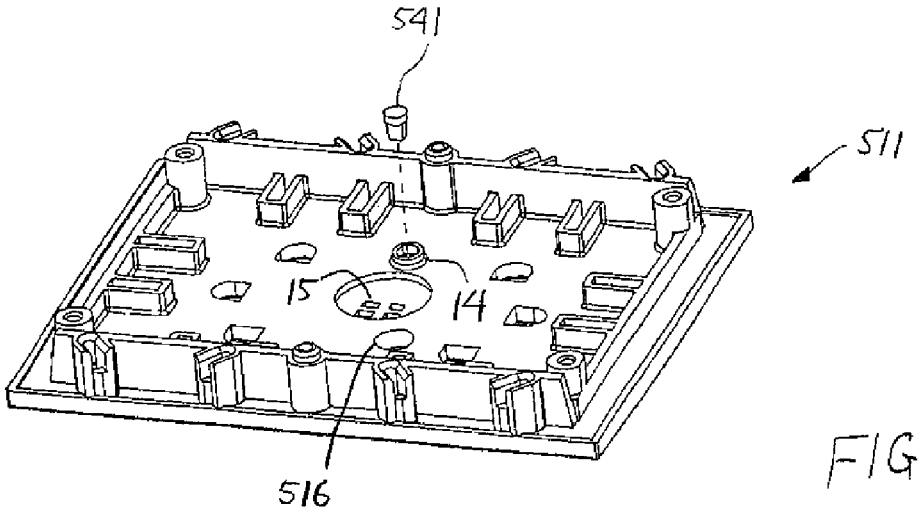
FIG. 22 shows the underside of a face cover assembly of a sixplex receptacle according to an embodiment of the invention.

FIG. 22 shows the underside of front cover assembly 511, with openings 514 and 515 formed in the central portion thereof. A lens 541 for transmitting light from the LED of the TVSS circuit is fitted into opening 514. Another opening 516 is provided so that a user may have access to the head of screw 531. This opening is preferably covered with an adhesive label 517 (as shown in FIG. 19) to discourage unnecessary disabling of the TVSS alarm.

Figure 23:
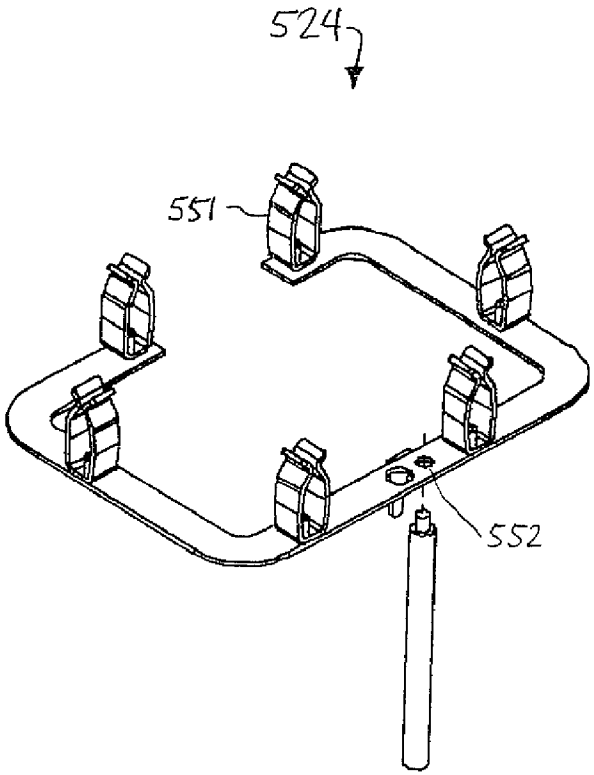
FIG. 23 shows a line bus assembly used in a sixplex receptacle according to an embodiment of the invention.

The line bus assembly 524 of this embodiment is shown in more detail in FIG. 23. The flat surface of the bus connector is held against the underside of the center assembly 522 by the back cover 525. The six contacts 551 are connected to the bus by suitable fasteners (e.g. rivets as in this embodiment). A wire leading to external line voltage is attached to the bus by a solder connection 552.

Figure 24:
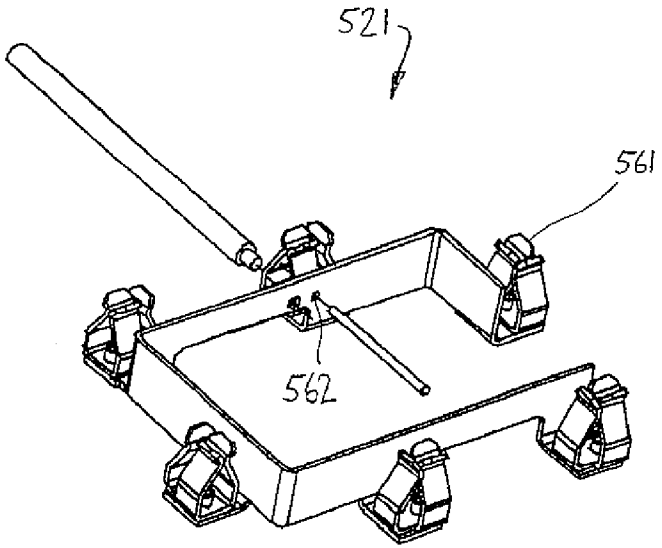
FIG. 24 shows a neutral bus assembly used in a sixplex receptacle according to an embodiment of the invention.

The neutral bus assembly 521 is shown in more detail in FIG. 24. As mentioned above, the vertical surfaces of the bus are generally adjacent to partitions in the center assembly 522. The six contacts 561 are connected to the bus by rivets or other suitable fasteners. A wire leading to an external neutral conductor is attached to the bus by a solder connection 562.

Figure 25:
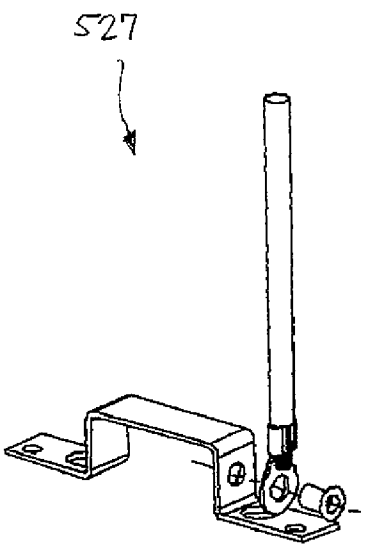
FIG. 25 shows a ground bridge assembly used in a sixplex receptacle according to an embodiment of the invention.

The ground bridge assembly 527, located on the exterior of the receptacle 501, also has a wire lead as shown in FIG. 25.

Figure 26C:
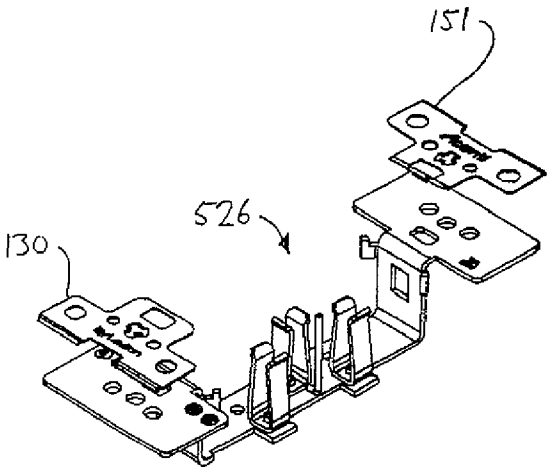
FIGS. 26A-26E show a ground strap and ground clip assembly used in a sixplex receptacle according to an embodiment of the invention.
Figure 26B:
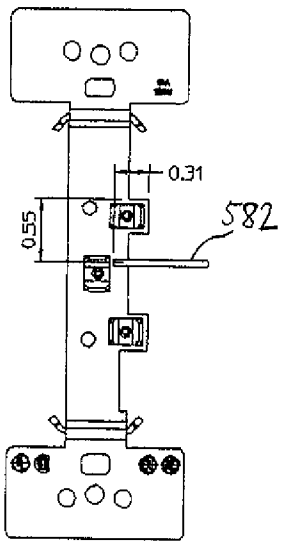
Figure 26A:
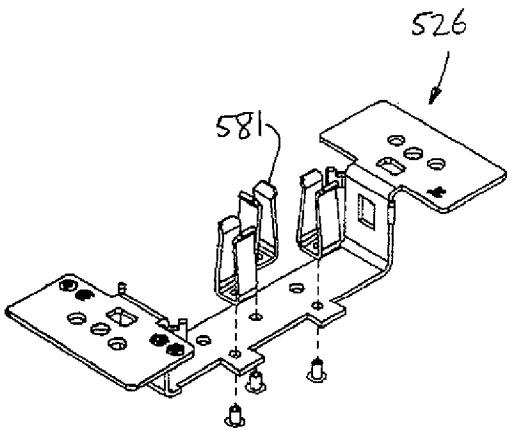

Each of the two ground strap assemblies 526 in this embodiment has three ground contacts 581 connected thereto, as shown in FIG. 26A. The ground contacts project through openings in the back cover and the center assembly toward the front face of the receptacle. As shown in FIG. 26B, one of the strap assemblies has a wire (typically copper) 582 welded thereto, for making a ground connection to the TVSS device.

Figure 26D:
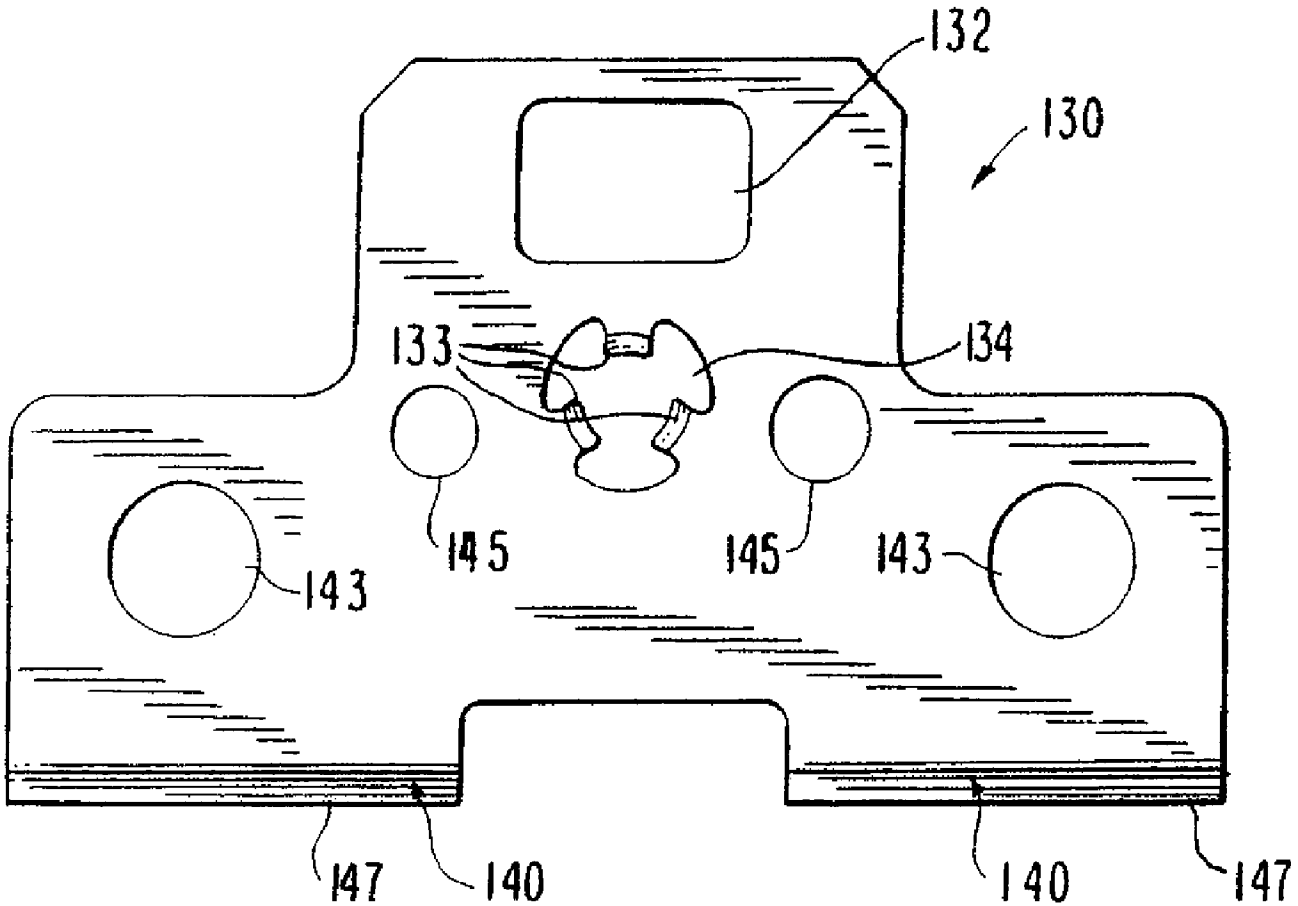
Figure 26E:
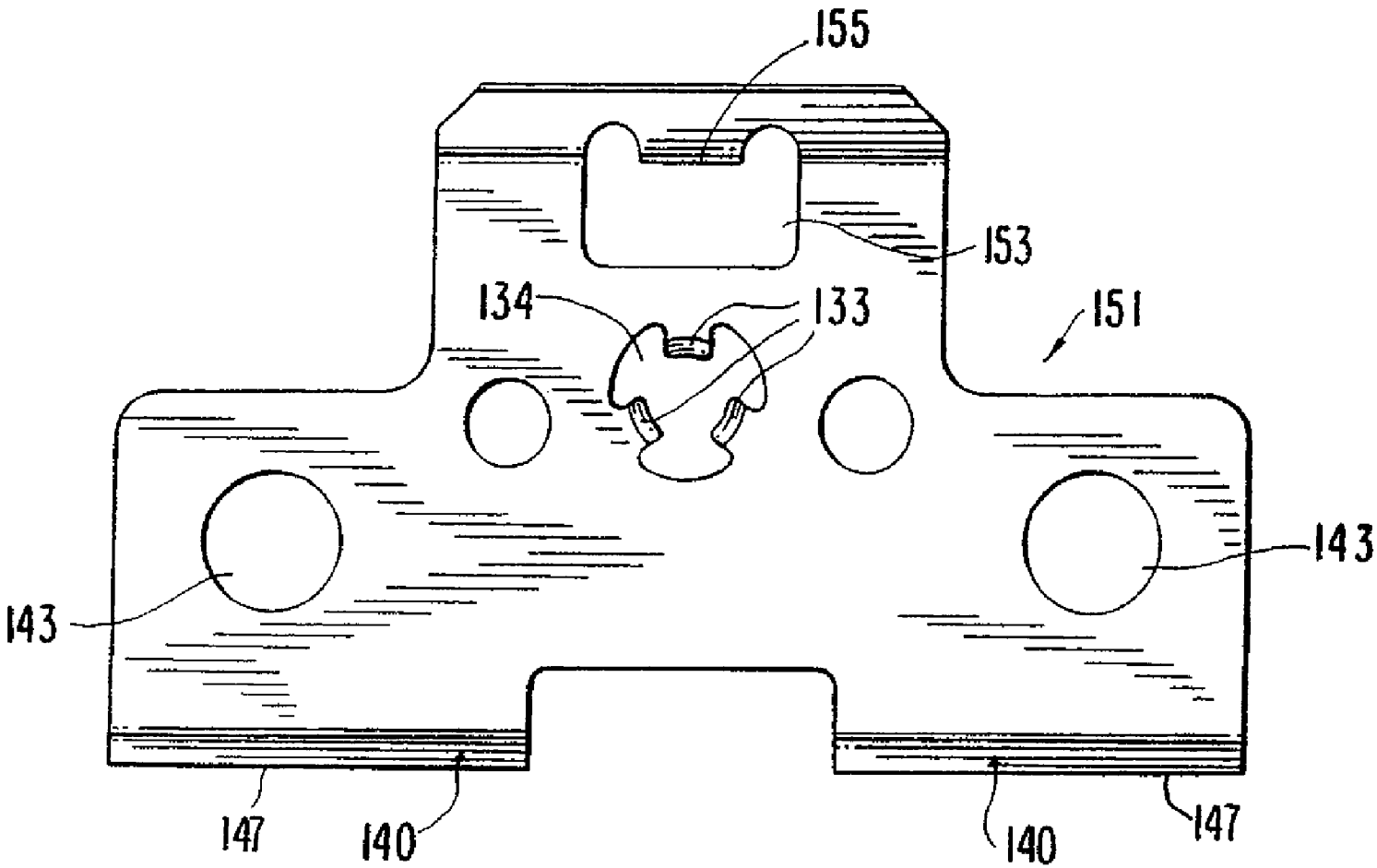

Multi-function clips 130, 151 are attached to the ends of the ground strap assemblies 526, as shown in FIG. 26C. These clips may be composed of phosphor bronze, spring brass, spring steel or the like. FIG. 26D shows details of clip 130 which is typically attached to the bottom end of strap assembly 526 (when the face of receptacle 501 is oriented vertically). Openings 132, 134 are aligned with corresponding openings in the end portion of ground strap assembly 526. Opening 132 is a clearance opening for a threaded fastener used to couple receptacle 501 to a box. The ends of three projecting members 133 serve to capture an alignment pin on an alignment plate (shown in FIG. 15). Clip 130 is fastened to strap assembly 526 preferably by using a TOX press process through openings 143; openings 145 provide alignment with corresponding openings at the end of strap assembly 526. The end 147 is bent upward to form a latching pawl 140, to engage the inside surface of a wall plate (shown in FIG. 15). FIG. 26E shows details of clip 151 which is typically attached to the top end of strap assembly 526. Clip 151 has openings similar to clip 130, and in addition has a tab 155 extending into opening 153 to engage and capture a fastener coupling the receptacle to a box. Further details of the function of clips 130, 151 are given in commonly assigned U.S. Pat. No. 7,030,318, the disclosure of which is hereby incorporated by reference.

Figure 27:
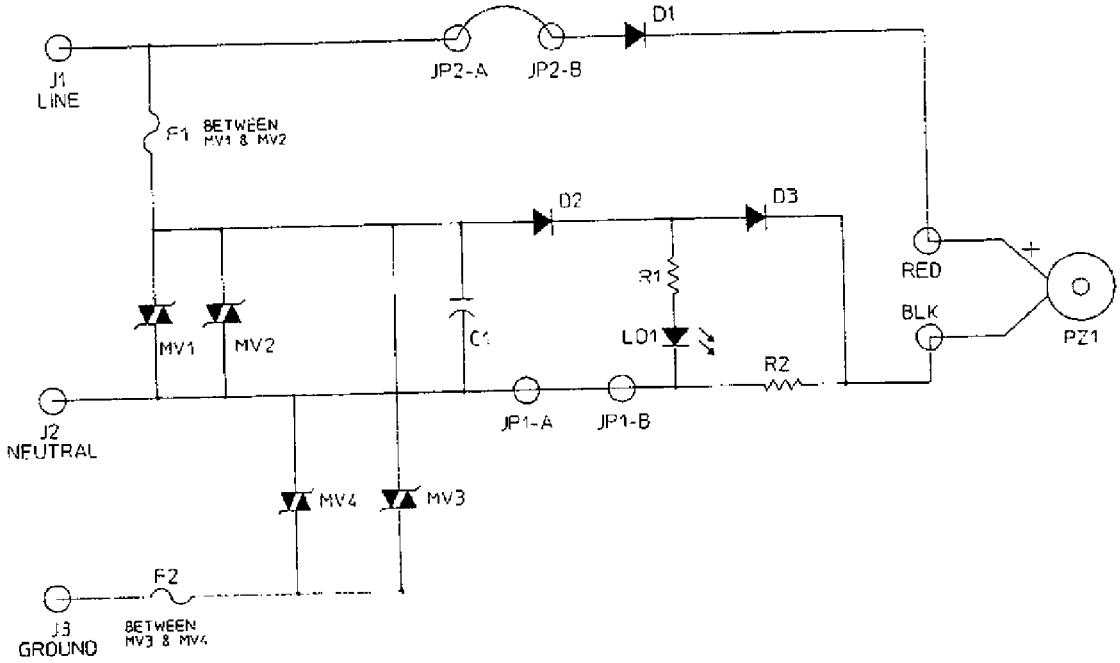
FIG. 27 is a schematic diagram of a TVSS device used in a receptacle according to an embodiment of the invention.

The TVSS circuit is integrated into receptacle 501, and in this embodiment is positioned in cavity 534 in center assembly 522. FIG. 27 is a schematic diagram of the circuit according to this embodiment. The line, neutral and ground connections J1, J2, J3 are formed by solder joints between wires and the line bus assembly 524, neutral bus assembly 521 and a ground strap assembly 526 respectively. As shown in FIG. 27, voltage surge protection is provided by two thermal cut-off (TCO) devices F1, F2 and four metal-oxide varistors (MOVs) MV1, MV2, MV3, MV4 connected between line and neutral conductors, line and ground conductors, and neutral and ground conductors. During normal operation of the circuit, LED LD1 conducts current and emits light through lens 541 (see FIG. 4); the light may be any color desired, but for a hospital-grade device a red color is specified. In this embodiment, the MOVs will break down at 400 V. If a voltage spike of 400 V or more is applied to the receptacle, the MOVs will fail, the light from LD1 will go out and the alarm buzzer PZ1 will sound. It should be noted that in this condition, the receptacle 501 will still deliver power, but will no longer have TVSS protection. A user may turn off the alarm by turning screw 531 so that contact is broken between leads 532 and 533.

Figure 28A:
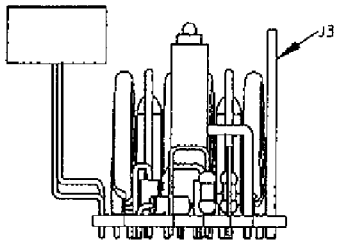
FIGS. 28A-28C are side, top and perspective views, respectively, of a TVSS device constructed according to FIG. 27.
Figure 28B:
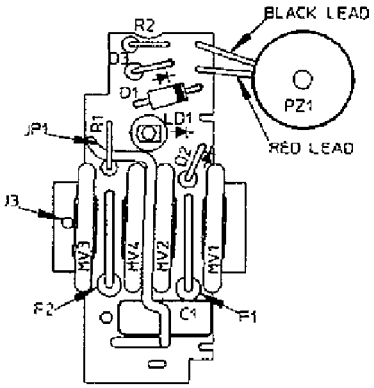
Figure 28C:
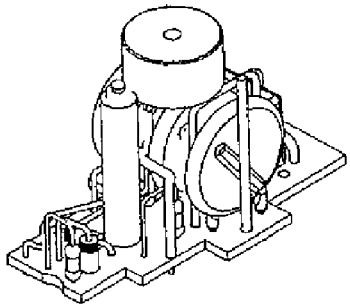

An embodiment of the TVSS device mounted on PCB 523 is shown in FIGS. 28A, 28B and 28C in side, plan and perspective views respectively. The four MOVs are arranged on edge, to make the PCB small enough to fit conveniently in the cavity 534 of center assembly 522. The wire ground lead J3 has a ground wire from the ground strap 526 wrapped around it, and secured with solder.

Figure 29:
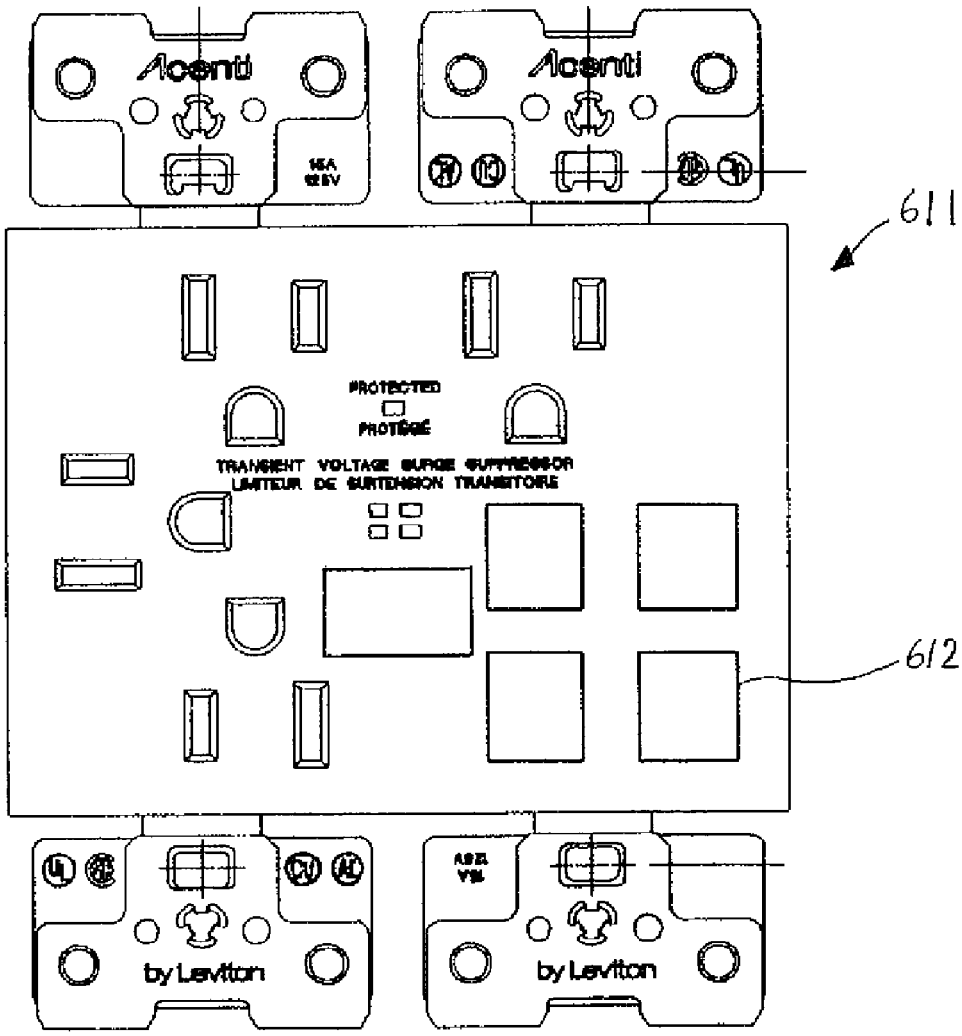
FIG. 29 is a plan view of a receptacle having both outlets and ports for low voltage devices and including a TVSS with a visual indicator and audible alarm, in accordance with another embodiment of the invention.

Another embodiment of the invention is shown in FIG. 29. Receptacle 611 has four standard 120 V AC outlets, and four openings 612 to receive connectors to low-voltage devices. (These connectors are sometimes called QuickPort® connectors.) These device connectors may include connectors for cable TV, satellite TV, voice, data, audio, RS232, USB, DVI (digital video input), AVI (analog video input), etc.

In addition, it will be understood that receptacle 501 may have a different number of outlets provided therein, e.g. four or five outlets in a double-gang unit. Similarly, receptacle 611 may have more or fewer openings 612 alongside more or fewer outlets in a single or multiple-gang unit as space permits. In an embodiment, receptacle 611 has three outlets in a triplex arrangement on one side of a double-gang box, and more openings 612 (typically six) occupying the other side of the double-gang box.

Figure 30A:
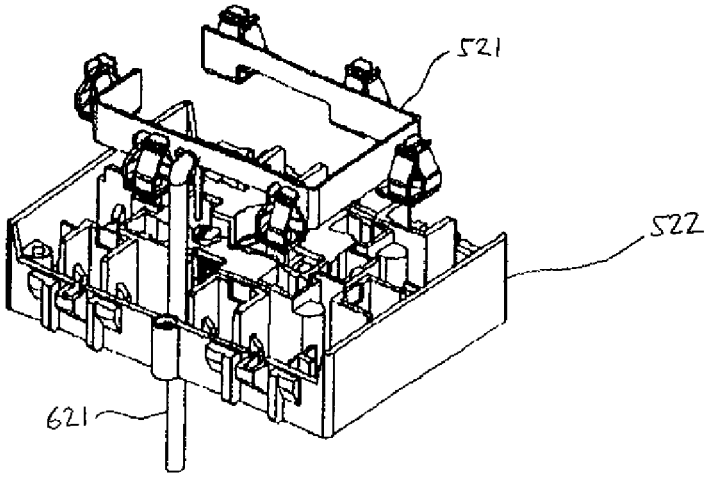
FIGS. 30A-30J illustrate steps in the assembly of a sixplex receptacle unit including a printed circuit board (PCB) with a TVSS, in accordance with another embodiment of the invention.
Figure 30B:
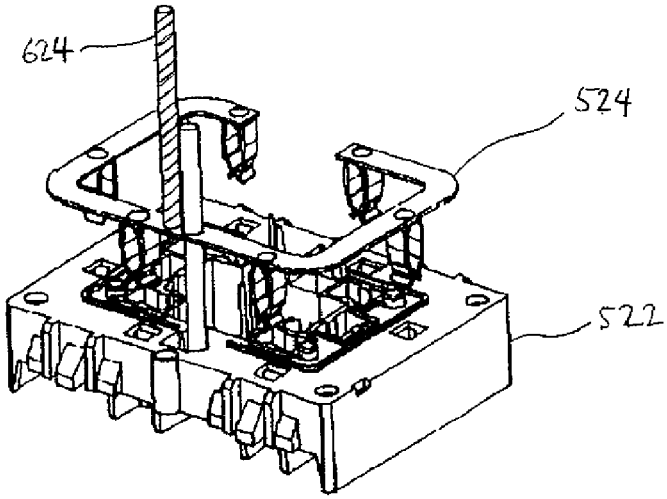

Assembly of a receptacle according to the above-described embodiments may be performed by following the steps shown in FIGS. 30A-30J. Neutral bus assembly 521 slides between partitions in center assembly 522; neutral connector wire 621 (typically white in color) is fed through a hole in bus assembly 521 and secured by a solder joint (FIG. 30A). Line bus assembly 524 sits flat against the underside of center assembly 522; line connector wire 624 (typically black in color) is fed through a hole in bus assembly 524 and secured by a solder joint. As shown in FIG. 30B, the neutral connector wire 121 runs through a hole in the line bus assembly 524, so that wires 621 and 624 are adjacent and parallel. It should be noted that the wires leading from receptacle 501 for making external connections are soldered to the bus assemblies, rather than attached using screw terminals. This is done to obtain a higher quality electrical connection and to save space in the interior of the receptacle.

Figure 30C:
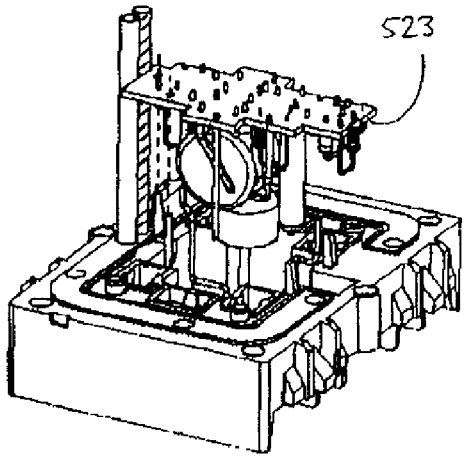
Figure 30D:
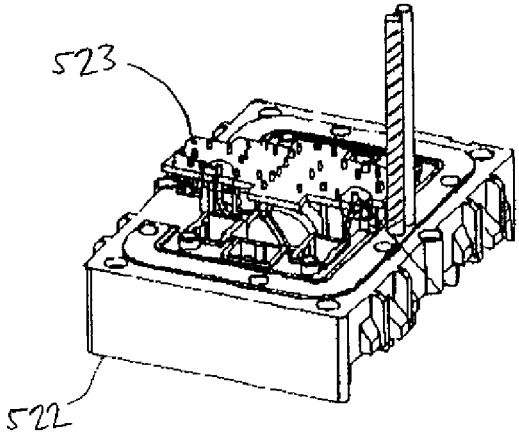
Figure 30E:
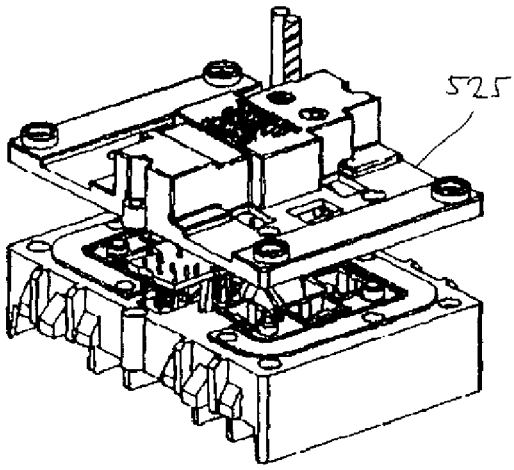
Figure 30F:
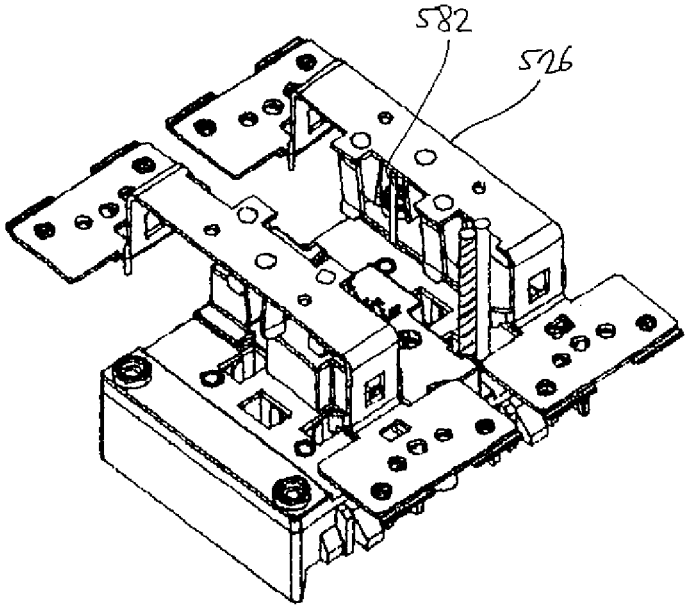

The PCB 523, with the TVSS circuit as described above, is fitted into the center assembly 522 (FIG. 30C). A portion of the PCB sits flat against the underside of the center assembly (FIG. 30D). Solder joints are formed to establish line and neutral electrical connections to the PCB. The back cover 525 is placed over center assembly 522, with wires 621 and 624 led through openings in the back cover (FIG. 30E). The back cover is then secured to the center assembly. A bare copper wire 582 is soldered to one of the ground strap assemblies 526. The ground strap assemblies 526 are then fitted securely against the back cover and the sides of the center assembly (FIG. 30F), with the bare wire sliding adjacent to connector J3 on the PCB.

Figure 30G:
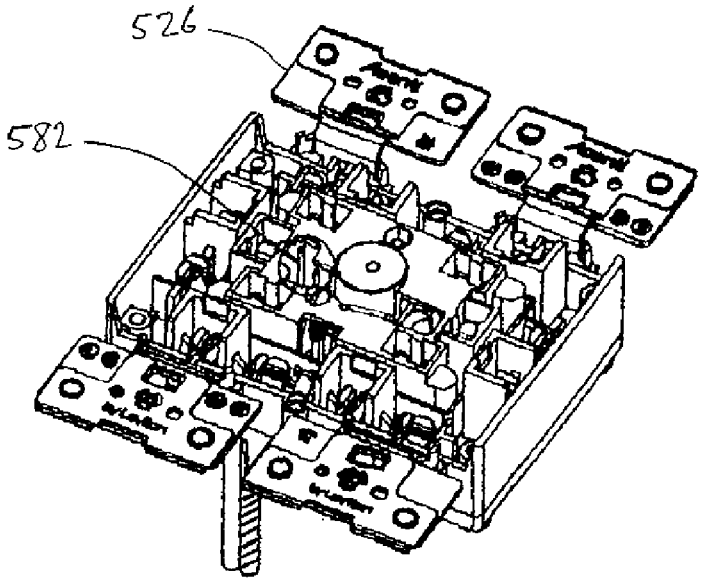
Figure 30H:
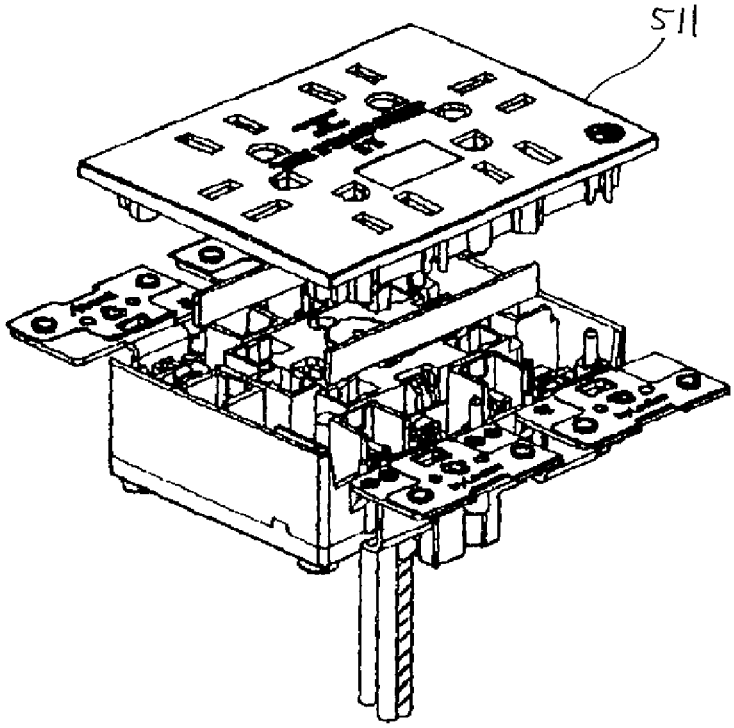
Figure 30I:
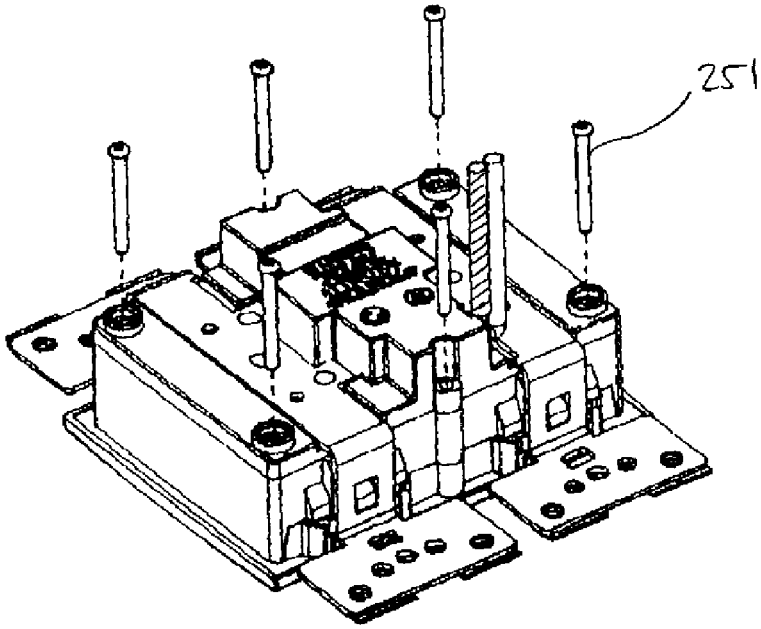
Figure 30J:
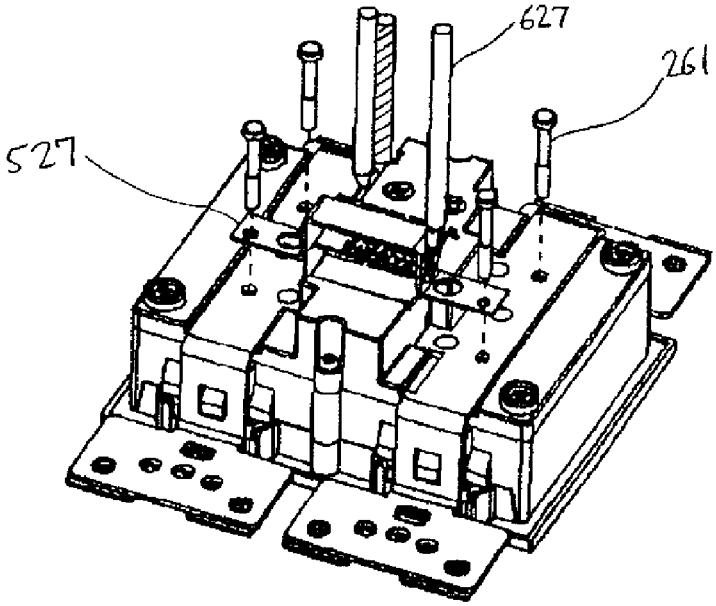

The bare wire 582 is wrapped around connector J3 and secured using solder, to make a reliable ground connection to the PCB (FIG. 30G). Front cover assembly 511, with LED lens 541 fitted therein, is placed over the top of center assembly 522 (FIG. 30H). Screws 251 secure the front cover assembly 511 to back cover 525 through holes in center assembly 522 (FIG. 30I). Ground bridge assembly 527, including ground connector wire 627, is then secured to ground strap assemblies 26 and center assembly 522 using pins 261 (FIG. 30J).

A receptacle as described above may be mounted in a double ganged box 160 using an alignment plate 358 and a wall plate 338 having an opening 360, as shown in FIG. 15. The alignment pins 370 engage openings 134 in clips 130 and 151. Wall plate 338 has racks 346 for receiving the latching pawls 140 of clips 130 and 151.

In the embodiments described above, a double gang receptacle includes three, four, five or six outlets with a TVSS device; in some arrangements the outlets are alongside one or more openings for low-voltage device connectors. In other embodiments, the receptacle may include a ground-fault circuit interrupter (GFCI), an integrated circuit breaker and/or an integrated night light instead of, or in addition to, the TVSS already described. In still other embodiments, a single or multiple-gang unit (that is, larger than a double box) may have a different number of outlets and/or low-voltage device connector openings.

The above-described embodiments include grounding strap assemblies and bridge assemblies for connecting the ground contacts of the receptacle to the box. Alternatively, the receptacle may be configured as an isolated ground receptacle in which a ground conductor, connected to the ground contacts of the receptacle, is led through the box to a grounding point but is not connected to the box. In addition, it will be appreciated that the outlets in the above-described embodiments may be configured as tamper-resistant outlets in accordance with NEC Article 517.18(C).

Furthermore, it will be appreciated that a receptacle as in the above-described embodiments may be constructed in a multi-gang modular configuration rather than a single integral unit. For example, one half of a double-box receptacle may have an opening formed therein for receiving a modular unit including three outlets, while the other half has an opening formed therein for receiving a modular unit having six low-voltage device connector openings. Power connections to the modules are made using a backplane in each of the gangs, as is understood by those skilled in the art.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A multiple outlet receptacle unit comprising:

a body configured to be mounted and installed within an in-wall-mounted box in the form of a single gang box;

a plurality of outlets on the body comprising at least three outlets positioned in a single face of said body, each outlet having a first blade opening configured to receive a first blade to make a line connection, a second blade opening configured to receive a second blade to make a neutral connection, and a third opening configured to receive a ground prong to make a ground connection wherein said first and second blade openings for at least one outlet of said at least three outlets are positioned at a right angle to said first and second blade openings of another outlet of said at least three outlets;

a protection circuit integrated into the body, the protection circuit including at least one of a transient voltage surge suppressor (TVSS), a ground-fault circuit interrupter (GFCI) and an integrated circuit breaker; and a first indicator device providing a visual signal regarding normal operation of the outlets.

2. The multiple outlet receptacle unit according to claim 1, further comprising a second indicator device providing an audible signal in accordance with disabling of the protection circuit.

3. The multiple outlet receptacle unit according to claim 1, wherein the protection circuit comprises a transient voltage surge suppressor (TVSS).

4. The multiple outlet receptacle unit according to claim 1, further comprising at least one opening configured to receive a connector to a low-voltage device.

5. The multiple outlet receptacle unit according to claim 4, wherein said connector is selected from the group consisting of connectors for cable TV, satellite TV, voice, data, audio, RS232, USB, digital video input and analog video input.

6. The multiple outlet receptacle unit according to claim 1, wherein the body includes a TVSS and the outlets are effective to continue providing power while the TVSS is disabled.

7. The multiple outlet receptacle unit according to claim 2, further comprising a user-accessible mechanism configured to disable the second indicator device.

8. The multiple outlet receptacle unit according to claim 1, further comprising an integrated night light.

9. The multiple outlet receptacle unit according to claim 1, wherein the outlets are configured in accordance with any of NEMA specifications 5-15R, 5-20R, 6-15R and 6-20R.

10. The multiple outlet receptacle unit according to claim 1, wherein the body is configured as an isolated ground receptacle.

11. The multiple outlet receptacle unit according to claim 1, wherein at least one outlet is configured as a tamper resistant outlet.

12. The multiple outlet receptacle unit according to claim 1, further comprising a modular portion having an opening formed therein and configured to receive a modular unit, so that the body has a modular configuration.

13. The multiple outlet receptacle unit according to claim 3, wherein the TVSS includes a plurality of metal-oxide varistors (MOVs).

14. The multiple outlet receptacle unit according to claim 3, wherein the first indicator device is a light-emitting diode (LED) integrated in the TVSS.

15. The multiple outlet receptacle unit according to claim 1, further comprising a line bus assembly having three line connectors each aligned with the first blade openings of the respective outlets, the line bus assembly having a wire connected thereto by a solder joint.

16. The multiple outlet receptacle unit according to claim 1, further comprising a neutral bus assembly having three neutral connectors each aligned with the second blade openings of the respective outlets, the neutral bus assembly having a wire connected thereto by a solder joint.

17. The outlet receptacle as in claim 1 wherein for each outlet, the ground connection openings are positioned adjacent to each other.

18. The outlet receptacle as in claim 1, wherein said first indicator device is located on a same side as said outlets.

19. The outlet receptacle as in claim 1, wherein two of said three outlets having their first blade openings disposed along a set of parallel lines and the third of said three outlets having its first blade opening disposed substantially at right angles to the set of parallel lines.

20. The outlet receptacle as in claim 1, wherein said protection circuit provides protection for all of said outlets which are all located on a same plane.

21. A multiple outlet receptacle unit comprising:

a body which is configured to be mounted and installed within a double-gang box, a plurality of outlets on the body comprising at least six outlets positioned in a single face of said body, each outlet having a first blade opening configured to receive a first blade to make a line connection, a second blade opening configured to receive a second blade to make a neutral connection, and a third opening configured to receive a ground prong to make a ground connection;

the body has a first portion and a second portion, each portion including three outlets arranged in a triplex arrangement characterized by two of said three outlets having their first blade openings disposed along a set of parallel lines and the third of said three outlets having its first blade opening disposed substantially at right angles to the set of parallel lines; and a protection circuit integrated into the body, the protection circuit including at least one of a transient voltage surge suppressor (TVSS), a ground-fault circuit interrupter (GFCI) and an integrated circuit breaker; and a first indicator device providing a visual signal regarding normal operation of the outlets.

22. The multiple outlet receptacle unit according to claim 21, wherein the protection circuit comprises a transient voltage surge suppressor (TVSS) disposed in a central portion of the body, and the outlets are arranged symmetrically with respect to a line dividing the first portion and the second portion.

23. The multiple outlet receptacle unit according to claim 21, wherein the body is configured to be mounted and installed within a multiple-gang box larger than a double-gang box.

24. The multiple outlet receptacle unit according to claim 21, wherein the protection circuit first indicator device and second indicator device are disposed in a central portion of the body, and the outlets are arranged symmetrically with respect to a line dividing the first portion and the second portion.

25. The multiple outlet receptacle unit according to claim 24, further comprising a line bus assembly having six connectors each aligned with the first blade openings of the respective outlets, the line bus assembly having a wire connected thereto by a solder joint.

26. The multiple outlet receptacle unit according to claim 24, further comprising a neutral bus assembly having six connectors each aligned with the second blade openings of the respective outlets, the neutral bus assembly having a wire connected thereto by a solder joint.

27. The multiple outlet receptacle unit according to claim 24, wherein the body is configured to be mounted and installed within a double-gang box.

28. The multiple outlet receptacle unit according to claim 21, wherein the body has a first portion and a second portion corresponding to a first box and a second box in said double-gang box, the first portion including three outlets arranged in a triplex arrangement characterized by two of said three outlets having their first blade openings disposed along a set of parallel lines and the third of said three outlets having its first blade opening disposed substantially at right angles to the set of parallel lines, the second portion including the protection circuit, first indicator device and second indicator device.

29. The multiple outlet receptacle unit according to claim 28, further comprising a line bus assembly having three connectors each aligned with the first blade openings of the respective outlets, the line bus assembly having a wire connected thereto by a solder joint.

30. The multiple outlet receptacle unit according to claim 28, further comprising a neutral bus assembly having three connectors each aligned with the second blade openings of the respective outlets, the neutral bus assembly having a wire connected thereto by a solder joint.

31. The multiple outlet receptacle unit according to claim 24, wherein said connector to a low-voltage device is selected from the group consisting of connectors for cable TV, satellite TV, voice, data, audio, RS232, USB, digital video input and analog video input.

32. A receptacle assembly comprising:

a body configured to mount in a double wall box, the body having a top member, wherein the top member has a surface with a plurality of openings therein, forming a plurality of sockets comprising at least six sockets, wherein said plurality of sockets each include a ground prong opening, a neutral blade opening and a phase blade opening, wherein each of said ground prong openings are positioned adjacent to each other, in an inner region of said top member, and inside of said neutral blade openings, and said phase blade openings;

wherein said at least six sockets comprise a first set of sockets and a second set of sockets wherein at least two slots of each socket of said first set of sockets are orientated substantially parallel to each other and at least two slots of each socket of said second set of sockets are orientated substantially parallel to each other.

33. The receptacle assembly as in claim 32, further comprising:

a plurality of busbars comprising:

i) a phase busbar being selectively insertable or removable from said body and having at least one terminal configured to connect to a phase line, and a plurality of contacts configured to connect to prongs of a plug; and ii) a neutral busbar having at least one terminal configured to connect to a neutral line, and a second plurality of contacts configured to connect to prongs of a plug.

34. The receptacle assembly as in claim 32, wherein said phase busbar extends in a serpentine path, and wherein said neutral busbar extends in a serpentine path.

35. An electrical device comprising:

a double ganged wall box which is mounted in a wall;

a body mounted in said double ganged box, the body having a top member, wherein the top member has a surface with a plurality of openings therein, forming a plurality of sockets comprising at least six sockets, wherein said plurality of sockets each include a ground prong opening, a neutral blade opening and a phase blade opening, wherein each of said ground prong openings are positioned adjacent to each other, in an inner region of said top member, and inside of said neutral blade openings, and said phase blade openings;

wherein said at least six sockets comprise a first set of sockets and a second set of sockets wherein at least one slot of each socket of said first set of sockets is orientated substantially parallel to each other and at least one slot of each socket of said second set of sockets is orientated substantially parallel to each other.

* * * * *

UNITED STATES PATENT AND TRADEMARK OFFICE
Certificate

Patent No. 8,011,937 B2 Patented: September 6, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dennis A. Oddsen, Eatons Neck, NY (US); Steve Zacharevitz, Northport, NY (US); Carlos Ramirez, Chula Vista, CA (US); and Kenneth J. Brown, Chula Vista, CA (US).

Signed and Sealed this Twentieth Day of March 2012.

TULSIDAS C. PATEL
*Supervisory Patent Examiner*
Art Unit 2839
Technology Center 2800